US005524465A

United States Patent [19]

Kajiwara et al.

[11] Patent Number: 5,524,465

[45] Date of Patent: Jun. 11, 1996

[54] WORK ROLLS CROSSING TYPE MILL, ROLLING SYSTEM AND ROLLING METHOD

[75] Inventors: Toshiyuki Kajiwara, Katsushika-ku; Yasutsugu Yoshimura, Hitachi; Takao Sakanaka, Hitachi; Shinichi Yasunari, Hitachi; Yoshio Takakura, Hitachi; Shinichi Kaga, Hitachi, all of Japan

[73] Assignee: Hitachi, Ltd., Tokyo, Japan

[21] Appl. No.: 130,546

[22] Filed: Oct. 1, 1993

Related U.S. Application Data

[63] Continuation-in-part of Ser. No. 859,945, Mar. 30, 1992, abandoned.

[30] Foreign Application Priority Data

| | | | |
|---|---|---|---|
| Mar. 29, 1991 | [JP] | Japan | 3-66007 |
| Feb. 6, 1992 | [JP] | Japan | 4-20956 |
| Oct. 2, 1992 | [JP] | Japan | 4-264706 |

[51] Int. Cl.[6] ..... B21B 27/10

[52] U.S. Cl. ..... 72/42; 72/201; 72/241.2; 72/247

[58] Field of Search ..... 72/42, 43, 201, 72/236, 241.2, 241.4, 241.8, 247

[56] References Cited

U.S. PATENT DOCUMENTS

| | | | |
|---|---|---|---|
| 3,208,253 | 9/1965 | Roberts | 72/21 |
| 3,709,012 | 1/1973 | Larsonneor | 72/43 |
| 4,194,382 | 3/1980 | Kajiwara | 72/241.8 |
| 4,418,559 | 12/1983 | Huzyak | 72/201 |
| 4,644,774 | 2/1987 | van Steden | 72/201 |
| 4,653,303 | 3/1987 | Richard | 72/236 |
| 4,671,091 | 6/1987 | Atack et al. | 72/201 |
| 4,709,568 | 12/1987 | Ticehurst et al. | 72/201 |
| 4,889,648 | 12/1989 | Higaki et al. | 72/42 |
| 4,909,951 | 3/1990 | Mendelson et al. | 72/42 |
| 4,912,955 | 4/1990 | Stines | 72/201 |
| 5,046,347 | 9/1991 | Crosato et al. | 72/201 |

FOREIGN PATENT DOCUMENTS 0184481 6/1986 European Pat. Off. .

(List continued on next page.)

OTHER PUBLICATIONS

Kajiwara et al., The Hitachi Hyoron, vol. 75, No. 6, 1993, pp. 4–11.

Basical Characteristics of Pair Cross Mill, vol. 21, No. 6, 1984, pp. 61–67.

*Primary Examiner*—Lowell A. Larson
*Assistant Examiner*—Thomas C. Schoeffler
*Attorney, Agent, or Firm*—Evenson McKeown Edwards & Lenahan

[57] ABSTRACT

A lubricant is supplied from headers of lubricant supply units onto surfaces of back-up rolls at locations spaced from contact positions between a pair of work rolls and a pair of back-up rolls. The headers each include a lubricant spray nozzle for spraying the lubricant under a pressure not lower than 3 kg/cm$^2$, a header cover for confining the lubricant sprayed from the lubricant spray nozzle, an oil return line for returning the surplus lubricant, and seal members made of flexible material such as rubber. The work rolls are provided with water wiping plates, and the back-up rolls are also provided with water wiping plates. In a work rolls crossing type mill thus arranged, water films of cooling water deposited on the roll surfaces are removed to prevent the cooling water from mixing into the lubricant. Even if the water films are not totally removed, it is possible to surely plate out the lubricant for reliably lubricating between the work rolls and the back-up rolls. Raw lubricant oil of the lubricant meets the following requirements; (a) the coefficient of friction between said work rolls and said back-up rolls is in the range of 0.04 to 0.1, (b) the viscosity is not larger than 80 Cst. at 40° C., (c) mineral oil and synthetic ester not less than 5% are contained as base oil, (d) a fatty acid in the range of 0.03 to 0.5% is contained as an oiliness enhancer, (e) an extreme pressure additive not less than 0.1% is contained, and preferably, (f) a surface active agent not larger than 0.5% is contained as emulsifier.

28 Claims, 15 Drawing Sheets

FOREIGN PATENT DOCUMENTS

| | | | |
|---|---|---|---|
| 0367967 | 5/1990 | European Pat. Off. . | |
| 0506138 | 9/1992 | European Pat. Off. . | |
| 47-27849 | 10/1972 | Japan . | |
| 0045583 | 3/1980 | Japan | 72/241.2 |
| 0199501 | 12/1982 | Japan | 72/236 |
| 0013504 | 1/1984 | Japan | 72/241.2 |
| 59-169608 | 9/1984 | Japan . | |
| 60-199504 | 10/1985 | Japan . | |
| 61-7009 | 1/1986 | Japan . | |
| 62-142011 | 6/1987 | Japan . | |
| 63-30106 | 2/1988 | Japan . | |
| 1-21870 | 8/1989 | Japan . | |
| 3-234305 | 10/1991 | Japan . | |
| 2141959 | 1/1985 | United Kingdom . | |

CONTACT PORTION BETWEEN BACK-UP ROLL AND SEAL $f_W$ : WORK ROLL THRUST COEFFICIENT
$F_W$ : WORK ROLL THRUST FORCE
$f_B$ : BACK-UP ROLL THRUST COEFFICIENT
$F_B$ : BACK-UP ROLL THRUST FORCE
$F_{WS}$ : MATERIAL-WORK ROLL THRUST FORCE
$f_{WS}$ : MATERIAL-WORK ROLL THRUST COEFFICIENT
BUR : BACK-UP ROLL
WR : WORK-ROLL
P : ROLLING ROAD

WORK ROLLS CROSSING TYPE MILL, ROLLING SYSTEM AND ROLLING METHOD

CROSS-REFERENCE TO RELATED APPLICATION

This is a continuation-in-part of U.S. Ser. No. 07/859,945 filed on Mar. 30, 1992, now abandoned, the contents of which are incorporated herein by reference.

BACKGROUND OF THE INVENTION

The present invention relates to a mill in which work rolls are crossed each other to provide a high strip crown control capability for strips, and more particularly to a work rolls crossing type mill which can lubricate between back-up rolls and work rolls, a rolling system incorporating at least one such mill, and a rolling method.

As one of work rolls crossing type mills, JP, A, 47-27159 discloses a mill in which only work rolls are crossed each other.

There is also known, as described in Mitsubishi Heavy Industries Technical Report Vol. 21, No. 6, a mill in which a pair of an upper work roll and an upper back-up roll and a pair of a lower work roll and a lower back-up roll are each built into a one-piece roll set and arranged such that axes of the pair rolls (roll sets) are crossed with respect to each other.

Additionally, there are known 4-high work rolls crossing mills in which a lubricant is applied for the purpose of reducing thrust forces produced between work rolls in a roll kissed condition after strips have passed the work rolls, as disclosed in JP, A, 3-234305; an ordinary 4-high work rolls uncrossing mill in which a coolant is applied to work rolls and back-up rolls in a casing provided on the strip entrance side, and a lubricant as rolling oil is separately supplied to between the work rolls and a strip, as disclosed in JP, A, 61-7009; and a mill in which a lubricant as rolling oil is supplied only when a strip is in contact with rolls, as disclosed in JP, A, 47-27849.

SUMMARY OF THE INVENTION

The work rolls crossing type mill disclosed in JP, A, 47-27159 was expected to be adaptable for various needs of strip crown by crossing the upper and lower work rolls with respect to each other at various angles so as to change a roll gap between the work rolls. In fact, however, a relative slippage between the work roll and the back-up roll produces too large thrust forces to realize practical use.

In the mill described in Mitsubishi Heavy Industries Technical Report Vol. 21, No. 6, a pair of work roll and back-up roll are built into a one-piece roll set and two pairs of roll sets are crossed each other. Accordingly, there is produced neither a relative slippage between the work roll and the back-up roll, nor large thrust forces. However, because one pair of work roll and back-up roll is crossed as one-piece to the other pair, the center of a metallic chock for the back-up roll which directly receives a rolling load is offset from the center of a reduction screw, whereby a moment is generated to impede the smooth movement. For this reason, the mill adopts a structure using beams of large rigidity to keep a balanced condition. This structure resulted in a problem of necessarily complicating the mill and increasing its size.

The prior art disclosed in the above-cited JP, A, 3-284305 is effective in reducing the thrust forces imposed on the work rolls in the kissed condition, but cannot solve the problem relating to the thrust forces between the work roll and the back-up roll. Also, the prior arts disclosed in the above-cited JP, A, 61-7009 and JP, A, 47-27849 cannot solve the problem relating to the thrust forces between the work roll and the back-up roll.

With the above prior art in mind, as a method of more easily reducing the thrust forces, a mill of the type wherein only work rolls are crossed with respect to each other while keeping back-up rolls in parallel relation, and a lubricant is supplied to between the work rolls and the back-up rolls has been previously invented and was filed on Mar. 30, 1992 as the above-identified U.S. Ser. No. 07/859,945 corresponding to Japanese Patent Application No. 4-20956. This type mill is intended not to eliminate a relative slippage between the work roll and the back-up roll, but to reduce, by supplying the lubricant, the thrust forces produced with the relative slippage. Using the method of the prior application can relatively easily reduce the thrust forces, thus making it possible to realize the relatively simple structure and reduce the mill size.

It was, however, found that the above prior application stood further improvement in points of a lubricant supply unit and a lubricating function.

More specifically, in an ordinary mill, a coolant (cooling water) is sprayed to work rolls for cooling them. In the work rolls crossing type mill of the prior application, therefore, the coolant forms a water film which adheres onto the surfaces of the work rolls and is then brought into between the work rolls and the back-up rolls, or the sprayed coolant directly enters between the work rolls and the back-up rolls to be mixed to the lubricant. This raises a problem of difficulties in surely developing a lubricating function.

Further, in the above prior application, a lubricant based on mineral oil that loses a lubricating ability at high temperature is supplied to between the work rolls and the back-up rolls (hereinafter referred to also as between the rolls) to solve the problem of surely biting a hot strip while reducing the thrust forces between the rolls. However, reducing the thrust forces between the rolls and ensuring an ability of biting a hot strip are minimum requirements to be met for realizing the work rolls crossing type mill. To apply the lubricant to an actual machine, such other requirements that the lubricant enables stable operation for a long period of time under severe usage conditions in rolling load, speed and so on, and that the cooling water mixed with the lubricant can be easily treated, must be also satisfied.

In other words, it is essential for the lubricant to meet not only the above requirements on biting and thrust forces, but also the following requirements:

- the coefficient of friction can be ensured at a level enough to prevent the occurrence of a slippage between the rolls when the rolls are sped up and down;
- vibrations caused by a slip speed due to crossing between the rolls are not produced;
- pipes, nozzles, etc. of a lubricant supply unit are not clogged and the lubricant has preferable fluidity allowing it to be uniformly coated over the roll surface in an axial direction; and
- the lubricant mixed into a large amount of coolant (cooling water) can be relatively easily separated by a separating coagulant or the like.

A first object of the present invention is to improve a lubricant supply unit and provide a work rolls crossing type mill, a rolling system and a rolling method which can reliably lubricate between work rolls and back-up rolls.

A second object of the present invention is to improve functions of a lubricant and provide a work rolls crossing type mill and a rolling method in which the lubricant enables stable operation of the mill, and by which a coolant mixed with the lubricant can be easily treated.

To achieve the above first object, according to the present invention, there is provided a work rolls crossing type mill comprising a pair of work rolls, a pair of back-up rolls for respectively supporting said pair of work rolls, and cooling means for spraying a coolant onto said pair of work rolls from the exit or entrance side of said mill for cooling said pair of work rolls, said pair of work rolls being inclined in horizontal planes and arranged such that axes of said pair of work rolls are crossed with respect to axes of said pair of back-up rolls, respectively, and those axes of said pair of work rolls are also crossed with respect to each other, wherein said mill further comprises lubricant supply units arranged to respectively face said pair of back-up rolls for spraying a lubricant onto surfaces of said back-up rolls at locations spaced from contact positions between said pair of work rolls and said pair of back-up rolls, thereby lubricating between said work rolls and said back-up rolls.

In the above mill, preferably, said lubricant supply units each comprise a lubricant spray nozzle for spraying the lubricant to a location on the surface of said back-up roll, a cover arranged to confine the lubricant sprayed from said lubricant spray nozzle for recovering the surplus lubricant therein, seal means provided in ends of said cover facing said back-up roll for sealing the inside of said cover, and a lubricant return passage for returning the surplus lubricant recovered in said cover.

In this connection, preferably, said seal means includes a flexible material coming into contact with said back-up roll, or a slit for jetting high-pressure gas onto said back-up roll.

Preferably, the above mill further comprises first water wiping means arranged in contact with surfaces of said work rolls at locations on the strip exit side just before contact positions between said work rolls and said back-up rolls, as viewed in directions of respective rotations of said pair of work rolls, for blocking the coolant so that the coolant sprayed onto said work rolls will not enter said contact positions.

Preferably, the above mill further comprises second water wiping means arranged in contact with the surfaces of said pair of back-up rolls for removing the coolant so that the coolant sprayed onto said pair of work rolls, deposited on the work roll surfaces and then carried over with rotations of said work rolls and said back-up rolls will not reach the locations where said lubricant supply units are arranged.

In the above mill, preferably, the lubricant supplied from said lubricant supply units contains raw lubricant oil based on a mixture of mineral oil and ester and added with necessary minimum amounts of a surface active agent and a fatty acid both acting to improve emulsification.

Further, preferably, the lubricant supplied from said lubricant supply units contains raw lubricant oil meeting the following requirements:

(a) the coefficient of friction between said work rolls and said back-up rolls is in the range of 0.04 to 0.1;

(b) the viscosity is not larger than 80 Cst (centi-strokes) at 40° C.;

(c) mineral oil and synthetic ester not less than 5% are contained as base oil;

(d) a fatty acid in the range of 0.03 to 0.5% is contained as an oiliness enhancer; and (e) an extreme pressure additive not less than 0.1% is contained.

In this connection, preferably, said raw lubricant oil further meets another requirement (f); a surface active agent is not contained as emulsifier in excess of 0.5%.

Also, preferably, the lubricant supplied from said lubricant supply units is a highly separable emulsion prepared by diluting said raw lubricant oil with water.

The lubricant supplied from said lubricant supply units may contain raw lubricant oil based on mineral oil and added with a surface active agent and a fatty acid for improvement of emulsification, or may be a highly emulsifiable and stable emulsion prepared by diluting said raw lubricant oil with water.

In the above mill, preferably, said pair of back-up rolls are each tapered at both end portions so that these tapered portions will not contact the surface of the corresponding work roll even when the roll surfaces are subjected to the Hertz deformation due to the rolling load and roll bending forces and the axis of said back-up roll and the axis of said work roll supported by said back-up roll approach each other, and those portions of said seal means facing said tapered portions are configured to match with said tapered portions to keep contact relation therebetween.

To achieve the above first object, according to the present invention, there is also provided a rolling system comprising said work rolls crossing type mill, and a lubricant circulating system including a lubricant reservoir for storing the surplus lubricant recovered by said lubricant supply units and a pump for supplying the lubricant to said lubricant supply units.

To achieve the above first object, according to the present invention, there is further provided a rolling system comprising at least one of said work rolls crossing type mill installed to be capable of tandem-rolling, and a lubricant circulating system including a lubricant reservoir for storing the surplus lubricant recovered by said lubricant supply units and a pump for supplying the lubricant to said lubricant supply units.

To achieve the above first object, according to the present invention, there is further provided a rolling method for use in a mill comprising a pair of work rolls and a pair of back-up rolls for respectively supporting said pair of work rolls, said method comprising the steps of spraying a coolant onto said pair of work rolls from the exit or entrance side of said mill for cooling said pair of work rolls; spraying a lubricant onto surfaces of said back-up rolls at locations spaced from contact positions between said pair of work rolls and said pair of back-up rolls for lubricating between said work rolls and said back-up rolls; and simultaneously controlling inclinations of said pair of work rolls in horizontal planes so that axes of said pair of work rolls are crossed with respect to axes of said pair of back-up rolls, respectively, and those axes of said pair of work rolls are also crossed with respect to each other, thereby controlling the strip crown of a strip to be rolled.

The above first object is achieved by the present invention operating as follows.

In the present invention constructed as set forth above, by spraying the lubricant from the lubricant supply units onto the surfaces of the back-up rolls at locations spaced from the contact positions between the work rolls and the back-up rolls in the work rolls crossing type mill, the lubricant sprayed onto the surfaces of the back-up rolls are carried over with rotation of the back-up rolls into the contact positions between the work rolls and the back-up rolls, thereby lubricating between the rolls. Thus, the lubricant is surely coated (hereinafter referred to as "plated out") over the roll surfaces without being impeded by the coolant gathering between the work rolls and the back-up rolls. As a result, thrust forces produced between the work rolls and the back-up rolls upon the work rolls being crossed with respect to each other can be effectively reduced.

In each of the lubricant supply units, the lubricant is sprayed to the aforesaid location on the back-up roll surface from the lubricant spray nozzle for supply to the roll surface. At this time, the spray is performed in a closed space defined by the cover for confining the lubricant sprayed from the lubricant spray nozzle and the roll surface. Therefore, the coolant sprayed onto the work roll is not mixed into the sprayed lubricant, and the lubricant satisfactorily deposits on the roll surface. Also, since a surplus part of the lubricant sprayed onto the roll surface is prevented from scattering to the outside, the amount of lubricant mixed into the coolant can be reduced and treatment of the coolant is facilitated. Further, the surplus lubricant that has been sprayed onto the back-up roll but not deposited on the roll surface, flown downwardly and recovered in the cover, is returned through the lubricant return passage.

The seal means provided at the ends of the cover facing the back-up roll seal the inside of the cover to surely prevent the coolant from mixing into the lubricant and also the lubricant from scattering to the outside. The seal means also serve to remove the water film left on the back-up roll surface. Accordingly, the lubricant is positively sprayed and plated out inside the cover.

The seal means are preferably of the contact type using a flexible material held in contact with the back-up roll, or the contactless type jetting high-pressure gas out of the slit onto the back-up roll surface. The seal means of any type can satisfactorily develop the function thereof.

The first water wiping means disposed in contact with the work roll surfaces on the strip exit side block the coolant sprayed onto the work rolls just before the contact positions between the work rolls and the back-up rolls, whereby the lubricating ability is not deteriorated with the coolant entering those contact positions. Also, the coolant is not directly deposited on the back-up rolls; hence it does not wash away the roll-to-roll lubricant plated out as mentioned above.

The coolant sprayed onto the work rolls and deposited on the work roll surfaces on the strip entrance side form water films which are carried over with rotation of the work rolls and the back-up rolls. However, this coolant or these water films are removed by the second water wiping means disposed in contact with the back-up roll surfaces to be prevented from reaching the locations where the lubricant supply units are arranged. Consequently, the lubricant is surely plated out without being affected by the water films.

Even if the water films are still present on the roll surfaces in spite of the seal means and the first and second water wiping means, the water films are broken through upon the lubricant sprayed from the lubricant spray nozzles under pressure, so that the lubricant is surely plated out over the roll surfaces.

When the roll surfaces are subjected to the Hertz deformation due to the rolling load and roll bending forces and the axes of the back-up roll and the work roll approach each other, both end portions of the back-up roll are so largely deformed that the seal means held in contact with those both roll end portions can no longer properly function. In the present invention, therefore, both the end portions of the back-up roll are tapered so that the tapered portions will not contact the surface of the work roll even in such an event. As a result, the tapered portions will not largely deform and the seal means configured to match with the tapered portions to keep contact relation therebetween can continue developing the function thereof.

Furthermore, in the present invention, the surplus lubricant recovered is returned to the lubricant reservoir through the lubricant return passage and supplied to the lubricant supply units again for reuse by circulation. Accordingly, the amount of lubricant to be mixed into the coolant can be reduced and the coolant can be more easily treated. Since the lubricant is not wasted in a large amount, lubrication can be achieved with the necessary minimum amount of lubricant.

To achieve the above second object, according to the present invention, there is provided a work rolls crossing type mill comprising a pair of work rolls and a pair of back-up rolls for respectively supporting said pair of work rolls, said pair of work rolls being inclined in horizontal planes and arranged such that axes of said pair of work rolls are crossed with respect to axes of said pair of back-up rolls, respectively, and those axes of said pair of work rolls are also crossed with respect to each other, wherein said mill further comprises lubricant supply units for supplying a lubricant to between said pair of work rolls and said pair of back-up rolls, said lubricant containing raw lubricant oil meeting the following requirements:

(a) the coefficient of friction between said work rolls and said back-up rolls is in the range of 0.04 to 0.1;

(b) the viscosity is not larger than 80 Cst (centi-stokes) at 40° C.;

(c) mineral oil and synthetic ester not less than 5% are contained as base oil;

(d) a fatty acid in the range of 0.03 to 0.5% is contained as an oiliness enhancer; and (e) an extreme pressure additive not less than 0.1% is contained.

In the above work rolls crossing type mill, preferably, said pair of work rolls are further able to shift in respective roll axial directions.

In this connection, preferably, said raw lubricant oil further meets another requirement (f); a surface active agent is not contained as emulsifier in excess of 0.5%.

To achieve the above second object, according to the present invention, there is also provided a rolling method for use in a mill comprising a pair of work rolls and a pair of back-up rolls for respectively supporting said pair of work rolls, said method comprising the steps of spraying a coolant onto said pair of work rolls from the exit or entrance side of said mill for cooling said pair of work rolls; controlling inclinations of said pair of work rolls in horizontal planes so that axes of said pair of work rolls are crossed with respect to axes of said pair of back-up rolls, respectively, and those axes of said pair of work rolls are also crossed with respect to each other, thereby controlling the strip crown of a strip to be rolled, while supplying a lubricant to between said pair of work rolls and said pair of back-up rolls for lubricating between said work rolls and said back-up rolls; and using, as said lubricant, raw lubricant oil meeting the foregoing requirements (a) to (e) or an emulsion of said raw lubricant oil.

In the above rolling method, preferably, the strip crown of a strip to be rolled is controlled by controlling shift amounts of said pair of work rolls in respective roll axial directions in addition to inclinations of said pair of work rolls.

In this connection, said raw lubricant oil further meets another requirement (f); a surface active agent is not contained as emulsifier in excess of 0.5%.

The above second object is achieved by the present invention operating as follows.

In the work rolls crossing type mill, generally, the thrust force imposed on each work roll is given by a difference between the thrust force applied from the back-up roll and the thrust force applied from the strip. In the present invention constructed as set forth above, if the coefficient of friction between the work roll and the back-up roll is set to be not larger than 0.1, the thrust load imposed on the work roll is held not larger than 5% of the rolling load at maximum, meaning that the thrust load is kept within the range of ordinary load capacity of the work roll. Also, the friction forces between the work roll and the back-up roll can be so reduced depending on conditions as to prevent vibrations attributable to a stick slip with an elastic deformation of the roll surface in the axial direction serving as a spring.

Because of being driven by the work roll, the back-up roll having large inertia would be likely to slip and cause local wear in its surface if the coefficient of friction between the rolls is too small. While a relatively large force corresponding to the balancing force of the work roll is usually applied to the back-up roll, it is required to drive the back-up roll even in such a case by overcoming resistance of seals etc. in the back-up roll chocks (corresponding to the coefficient of friction about 0.01), inertial torque necessary for the acceleration (corresponding to the coefficient of friction 0.02 to 0.03) and so on. In the present invention, by setting the coefficient of friction between the work roll and the back-up roll to be not smaller than 0.04, the back-up roll can be driven by overcoming the resistance of seals etc. in the back-up roll chocks, the inertial torque necessary for the acceleration and so on, without causing the back-up roll not to slip during acceleration after biting the strip and during deceleration after passing of the strip.

By using the raw lubricant oil that contains mineral oil and synthetic ester as base oil and that has the viscosity not larger than 80 cSt (centi-stokes). at 40° C. (normal temperature), the lubricant is so increased in its fluidity as not to clog in pipes, nozzles, etc. of the lubricant supply units. In addition, the lubricant is uniformly plated out over the roll surface, providing a uniformly lubricated condition in the roll axial direction.

Also, by using the raw lubricant oil that contains mineral oil and synthetic ester as base oil, since the lubricating ability of mineral oil and synthetic ester is remarkably lowered upon contacting the strip at a high temperature not lower than 700° C., the lubricant deposited on the work roll surface and brought into the area where the rolls are biting the strip will not impede the operation of biting the strip. Additionally, in the area where the rolls are crossed with respect to each other, the temperature is so raised with friction that oiliness provided by only the mineral oil becomes insufficient. By containing synthetic ester not less than 5%, however, the deficiency of oiliness in that rolls crossed area is compensated and the above-mentioned coefficient of friction ensured.

Further, by using the raw lubricant oil that contains a fatty acid as an oiliness enhancer, the fatty acid reacts with iron and forms strong metallic soap films on the roll surfaces so that the oil films will not break. No breakage of the oil films thus ensured enables prevention of the roll vibrations due to the stick strip. The fatty acid has an emulsifying action with which the lubricant is homogenized. As a result, the lubricant can be uniformly coated over the roll surface in the axial direction, providing a uniformly lubricated condition. However, if the amount of fatty acid exceeds 0.5%, the coefficient of friction between the rolls would be increased with an emulsifying action of the fatty acid. If the amount of fatty acid is too small, i.e., not larger than 0.03%, the coefficient of friction between the rolls would be also increased. In order to ensure the above suitable range of the coefficient of friction, therefore, the optimum amount of fatty acid ranges from 0.03% to 0.5%.

While the area between the work roll and the back-up roll is at a low temperature near the normal temperature as a whole, a part of that area may be locally heated up to above 200° C. due to friction caused by crossing of the rolls so that the aforesaid action of the fatty acid, i.e., the action of forming the metallic soap films, is lost. In the present invention, by using the raw lubricant oil that contains an extreme pressure additive not less than 0.1%, the lost effect in the action of the fatty acid is compensated to lower the coefficient of friction and suppress the occurrence of roll vibrations.

Additionally, a fatty acid has an emulsifying action as mentioned above. Therefore, if the lubricant contains too much fatty acid, it would become less separable from the cooling water. By holding the fatty acid down to not larger than 0.5%, emulsification of the lubricant mixed into the cooling water is suppressed to keep so good separability that the oil component in the cooling water can be easily removed by usual treatment employing a separating coagulant. The coolant is always recycled and also always replaced by fresh water while draining a part of the cycled water correspondingly. On this occasion, the drained water must be kept clean. Therefore, it is quite important that the oil component in the coolant can be easily separated.

While a fatty acid acts to emulsify the oil component and achieve homogeneous lubrication, a surface active agent may also be added as an emulsifier for further increasing such an action so that the roll surface can be more uniformly lubricated in the axial direction. As with the fatty acid, the surface active agent also increased the coefficient of friction between the rolls and make the lubricant less separable from the coolant, if added too much. Therefore, the amount of surface active agent is also desirably held down to not larger than 0.5% as with the fatty acid.

With the work rolls being shiftable in the roll axial directions, the strip crown can be controlled by controlling both the cross angle between the work rolls and the shift amounts thereof in the roll axial directions. The axial shifting of the work rolls also enables schedule-free rolling.

BRIEF DESCRIPTION OF THE DRAWINGS

FIG. 7 shows still another embodiment of the present invention in which.

DETAILED DESCRIPTION OF THE PREFERRED EMBODIMENTS

One embodiment of the present invention will first be described with reference to FIG. 1 to 5.

Figure 1:
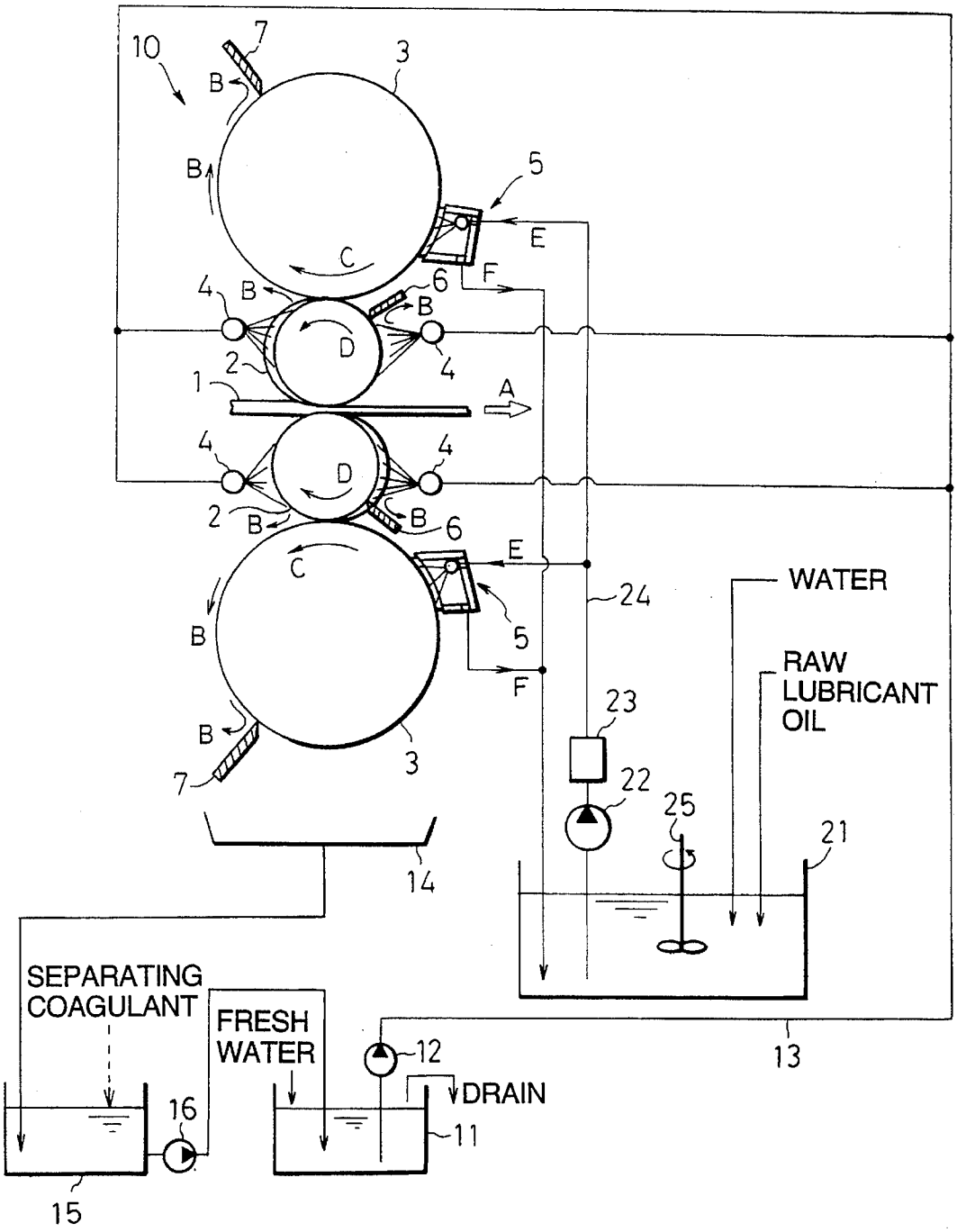
FIG. 1 is a diagram showing a mill and a rolling method according to one embodiment of the present invention.

As shown in FIG. 1, in a 4-high mill 10, a pair of upper and lower work rolls 2, 2 are arranged such that their roll axes are crossed with respect to to axes of a pair of upper and lower back-up rolls 3, 3, respectively, and they are also crossed with respect to each other. By controlling a cross angle between the upper and lower work rolls 2, 2, a strip 1 is rolled while being controlled in its strip crown. The work rolls 2, 2 can be inclined in horizontal planes by a not-shown mechanism with respect to the back-up rolls 3, 3, while making their roll axes crossed with respect to each other.

The mechanism for crossing the roll axes of the work rolls 2, 2 with respect to each other is described in detail in the above-cited U.S. Ser. No. 07/859,945 corresponding to Japanese Patent Application No. 4-20956. The back-up rolls 3, 3 are usually constructed with their roll axes not to be inclined in horizontal planes, but may be constructed such that their roll axes can be inclined in horizontal planes to any of three to four particular angles, but cannot be inclined to other angles. Also, the back-up rolls 3, 3 are usually fixed such that their roll axes are not to be freely inclined in horizontal planes during the rolling, but their roll axes may be inclined during the rolling depending on conditions.

Cooling headers 4 are provided at locations facing the work rolls 2 on the entrance and exit sides of the mill 10, and lubricant supply units 5 are provided along the surfaces of the back-up rolls 3 at locations spaced from the contact positions between the work rolls 2 and the back-up rolls 3. Further, water wiping plates 6 as first water wiping means are provided in contact with the surfaces of the work rolls 2 at locations on the strip exit side just before the contact positions between the work rolls 2 and the back-up rolls 3, and water wiping plates 7 as second water wiping means are provided in contact with the surfaces of the back-up rolls 3 on the strip entrance side. In FIG. 1, an arrow A indicates a direction of advance of strips, an arrow B a direction in which a coolant (hereinafter referred to as cooling water) is sprayed, and arrows C, D directions of rotation of the back-up rolls 3 and work rolls 2, respectively. The lubricant supply units 5 are schematically shown in FIG. 1.

The cooling headers 4 are supplied with the cooling water sent from a cooling water reservoir 11 by a pump 12 through a line 13, and the cooling water is sprayed from the cooling headers 4 for cooling the work rolls 2, 2. The cooling water that has a raised temperature and contains a large amount of scales or iron after cooling the work rolls 2 is collected into a pan 14 disposed below the mill along with hot rolling oil, a lubricant for between the rolls and/or oil coming out of the mill, and then sent to a water treating apparatus 15. The treated water is sent by a pump 16 to be stored in the cooling water reservoir 11 again for reuse by circulation. The water in the cooling water tank 11 is drained at a constant flow rate (e.g., 50 $m^3$/hr), while fresh water is resupplied at a constant flow rate (e.g., 50 $m^3$/hr) corresponding to the flow rate of the water drained.

The lubricant supply units 5 are supplied with a lubricant sent from a lubricant reservoir 21 by a pump 22 through a filter 23 and a line 24, and the lubricant is sprayed from the lubricant supply units 5 onto the surfaces of the back-up rolls 3. The locations of spraying the lubricant are along the surfaces of the back-up rolls 3 and spaced from the contact positions between the work rolls 2 and the back-up rolls 3, as mentioned above. Those spraying locations are set to such a distance that the lubricant is surely plated out over the surfaces of the back-up rolls 3 without being impeded by the cooling water, even if the cooling water is gathered between the work rolls 2 and the back-up rolls 3. With rotation of the back-up rolls 3, the plated-out lubricant is brought into the contact positions between the work rolls 2 and the back-up rolls 3 for lubricating between the rolls.

A mixture solution of water and oil, i.e., an emulsion, is often used as the lubricant. A raw lubricant oil for use in the lubricant is mainly divided into two types. One type is called stable oil that is stably held in an emulsion state, primarily based on mineral oil and prepared by diluting the mineral oil, added with a surface active agent and an emulsifier such as a fatty acid, with water. The stable oil is so soluble with the aid of the emulsifier that the water and the oil will not separate from each other even after left intact for a long period of time. The other type is called unstable oil that is unstable in an emulsion state, based on a mixture of tallow and mineral oil added with ester and prepared by diluting the mixture, added with a surface active agent and an emulsifier such as a fatty acid in a necessary lowest amount, with water. The unstable oil is so highly separable as to separate from water if not subjected to mechanical mixing such as agitation, but has a much greater lubricating ability than the stable oil.

The former stable oil becomes a stable emulsion usually having low viscosity smaller than 50 cSt (centi-stokes), can be relatively easily plated out with a uniform thickness over the roll surface, and further provides good lubrication between the rolls. Also, an oil film of the stable oil deposited on the work roll is burnt off by a strip at high temperature over 700° C. during the rolling and the lubricating ability is deteriorated, whereby the coefficient of friction is increased to 0.2 or more to ensure a good ability of biting the strip. Because of being soluble, however, oil must be forcibly separated from water by chemical treatment or other process when the water containing the oil is drained. In general, the oil component is separated by using an acid such as $H_2SO_4$ and neutralized with NaOH or the like, followed by coagulation and precipitation. An expensive drain treating equipment is therefore required. Additionally, since the oil component has a high density on the order of 104 to 105 ppm, a 2-stage process is required in such a manner that the density of the oil component is once lowered down below 103 ppm by providing a ultrafilter which mechanically separates the oil component using a permeable film or an evaporator which separates the water through evaporation prior to separation and coagulation by the chemical treatment, and the chemical treatment is then conducted.

On the other hand, the latter unstable oil is hard to become an emulsion and also unstable in an emulsion state. In order to uniformly and surely plate out the unstable oil over the roll surface, therefore, it is required to use base oil having low viscosity and sufficiently plate out the unstable oil by spraying it at an injection pressure higher than 2 kg/cm$^2$. However, when a film (spread) of the cooling water is present on the roll surface beforehand, the lubricant must be sprayed after breaking the water film, for the purpose of surely depositing the oil component on the roll surface. Accordingly, it is necessary in such a case to remove the water film on the roll surface in advance by using a water wiping seal and then spray the lubricant onto the exposed surface.

Once the unstable oil is deposited on the roll surface, its lubricating ability is much higher than the former stable oil. An ability of biting a strip in the case of using the unstable oil is also good, unless an additive such as hot rolling oil is added with a view of not lowering the lubricating ability at a high temperature. Further, because the emulsion of the unstable oil tends to easily separate, such a special treatment as required for the stable oil is not necessary for separation even if the unstable oil is mixed into the cooling water. In particular, when a conventional 4-high mill is modified to a work rolls crossing type mill, difficulties are encountered in additionally providing a drain treatment equipment, meaning that using the latter unstable oil is advantageous if possible.

Depending on the rotational speed of the rolls and the injection pressure from the header, an amount of lubricant several times the amount to be actually deposited is required to surely deposit the lubricant on the roll surface. If the surplus oil component of the lubricant which has not been used for lubrication is directly returned to the cooling water treating equipment along with the roll cooling water, the intended purpose of lubricating contact areas between tile work rolls and the back-up rolls could be achieved, but the amount of oil mixed into the circulating cooling water and to be treated would be so increased as to bring about the remarkable running cost. For that reason, this embodiment adopts a method of recovering the surplus lubricant more than required for lubrication and circulating it for reuse from the standpoint of economy.

More specifically, the surplus lubricant which has not been deposited on the back-up rolls 3 and flown downwardly is recovered by head covers 42 (described later) as components of the lubricant supply units 5 and returned to the lubricant reservoir 21. As the lubricant in the lubricant reservoir 21, a stable emulsion prepared by diluting stable oil, that is soluble with water and highly stable and emulsifiable, with water or an unstable emulsion prepared by diluting unstable oil, that is highly separable from water, with water is used on occasions depending on requirements. Stated differently, regardless of which one of the stable emulsion and the unstable emulsion is used, the lubricant can be surely plated out over the roll surfaces in this embodiment.

The lubricant reservoir 21 is resupplied with water and raw lubricant oil corresponding to amounts of consumption thereof, and the mixture or lubricant is always agitated by an agitator 25 to keep a emulsion property. A content of the raw lubricant oil in the lubricant is held at 3%, for example. The lubricant stored in the lubricant reservoir 21 is pumped up by the pump 22, passed through the filter 23 for removing impurities such as dusts, and then sprayed from the lubricant supply units 5. With such an arrangement, the lubricant is not mixed into the circulating cooling water except a part of the lubricant which is deposited on the roll surfaces and moved out of the lubricant supply units. Thus, there occur no problems in treatment of the cooling water even for the case of using the stable emulsion which is highly emulsifiable and stable, but poor in separability, not to speak of the case of using the unstable emulsion which is highly separable. As a result, the treatment of the cooling water is facilitated. Furthermore, lubrication between the rolls can be performed with the necessary minimum amount of lubricant.

The lubricant deposited on the rolls and used for lubrication between the work rolls 2 and the back-up rolls 3 is collected into the pan 14 below the mill along with the cooling water and sent to the water treating apparatus 15 for treatment, as mentioned above. Note that the lubricant reservoir 21, the pump 22, the filter 23, the line 24 and the agitator 25 jointly constitute a lubricant circulating system.

On the strip exit side, if the cooling water sprayed from the cooling headers 4 onto the work rolls 2 enters the contact positions between the work rolls 2 and the back-up rolls 3 or directly deposits on the back-up rolls 3, adhesion of the lubricant would be deteriorated or the lubricant would be washed out with the cooling water, resulting in a lower lubricating ability between the rolls. On the strip entrance side, the cooling water sprayed onto the work rolls 2 and deposited on the roll surfaces forms water films which are carried over with rotation of the work rolls and the back-up rolls. If such water films are brought into the locations where the lubricant is sprayed from the lubricant supply units 5 along the surfaces of the back-up rolls 3, the plating-out of the lubricant would be interfered with, similarly resulting in a lower lubricating ability between the rolls. This equally applies to not only the case of using stable oil as the raw lubricant oil, but also the case of using unstable oil as the raw lubricant oil.

To cope with the above drawbacks, the water wiping plates 6 block the cooling water just before the contact positions between the work rolls 2 and the back-up rolls 3 to thereby prevent the cooling water from entering those contact positions. Also, the water wiping plates 7 remove the water films on the surfaces of the back-up rolls 3 to thereby prevent the cooling water from being brought into the lubricant supply units 5. Thus, with the provision of the water wiping plates 6 and 7, the plating-out of the lubricant can be surely performed without being affected by the cooling water.

Figure 2:
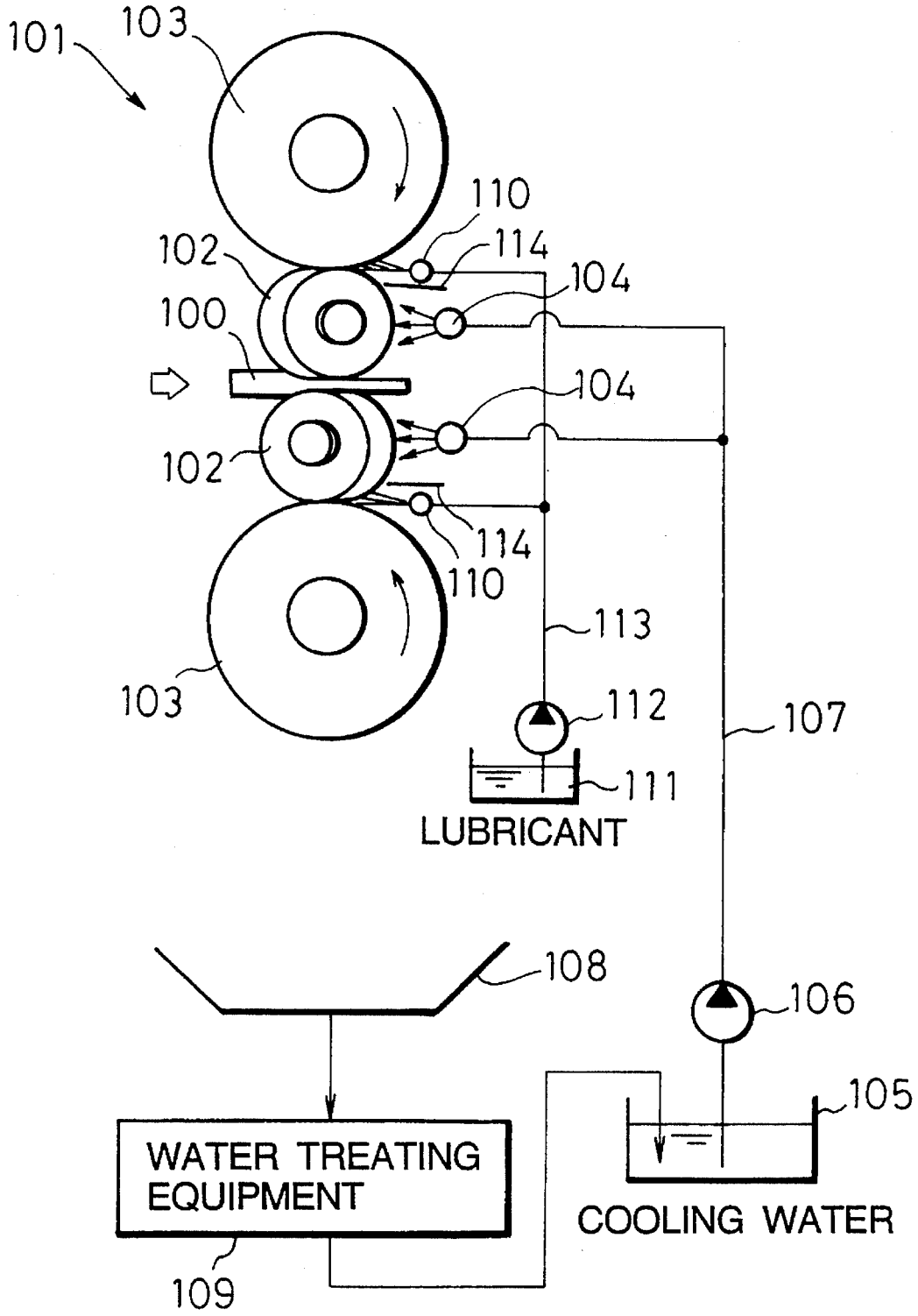
FIG. 2 is diagram showing a system for supplying a lubricant and a coolant to between rolls of a work rolls crossing type mill disclosed in U.S. Ser. No. 07/859,945 corresponding to Japanese Patent Application No. 4-20956.

A description will now be given of lubrication between the rolls in the work rolls crossing type mill disclosed in U.S. Ser. No. 07/859,945 corresponding to Japanese Patent Application No. 4-20956 with reference to FIG. 2. As shown in FIG. 2, in a work rolls crossing type mill 101, a pair of upper and lower work rolls 102, 102 are arranged such that their roll axes are crossed with respect to axes of a pair of upper and lower back-up rolls 103, 103, respectively, and they are also crossed with respect to each other. By controlling a cross angle between the upper and lower work rolls 102, 102, a strip 100 is rolled while being controlled in its strip crown. Cooling headers 104 are provided on the exit side of the mill 101, and cooling water sent from a cooling water reservoir 105 by a pump 106 through a line 107 is sprayed from the cooling headers 104 for cooling the work rolls 102, 102. The cooling water that has a raised temperature and contains a large amount of scales or iron after cooling the work rolls 102 is collected into a pan 108 disposed below the mill along with hot rolling oil, a lubricant for between the rolls and/or oil coming out of the mill, and then sent to a water treating equipment 109. The treated water is stored in the cooling water reservoir 105 again for reuse by circulation. The above construction is the same as that of this embodiment.

Also, headers 110 are provided to face gaps between the work rolls 102 and the back-up rolls 103 and are supplied with a lubricant sent from a lubricant reservoir 111 by a pump 112 through a line 113. The lubricant is sprayed to between the work rolls 102 and the back-up rolls 103 for providing a lubricating ability. Between the headers 104 and the headers 110, there are provided partitions 114 to prevent the cooling water from entering between the work rolls 102 and the back-up rolls 103 and washing out the lubricant.

In the above work rolls crossing type mill 101, the lubricant for between the rolls is directly sprayed to positions to be lubricated from the headers 110 provided to face the gaps between the work rolls 102 and the back-up rolls 103, thereby making lubrication between the work rolls 102 and the back-up rolls 103. With that mill of the prior application, however, the cooling water sprayed from the headers 104 for cooling the work rolls 102 deposits on the surfaces of the work rolls 102 in the form of water films which are brought into between the work rolls and the back-up rolls with rotation of the work rolls, thereby causing the cooling water to gather between the rolls. Alternatively, the cooling water sprayed from the headers 104 in the mist form directly enters between the rolls and gathers there. The water gathered between the rolls in any way makes it difficult to satisfactorily plate out the lubricant between the work rolls and the back-up rolls even if the lubricant is strongly sprayed out of the headers 110. Such gathering of the cooling water is prevented by the partitions 114 to some extent, as seen from FIG. 2, but the achieved result is not sufficient.

Particularly, in the case where the stable emulsion is used as the roll-to-roll lubricant, the lubricating effect is substantially lost because the roll-to-roll lubricant easily dissolves in the cooling water gathered between the work rolls 102 and the back-up rolls 103 and is washed out with the cooling water. On the other hand, in the case of using the unstable emulsion as the roll-to-roll lubricant, the roll-to-roll lubricant will not easily dissolve in the cooling water, but it cannot be also satisfactorily plated out by being impeded by the cooling water gathered.

On the contrary, in this embodiment, with the above-mentioned arrangement that the locations of spraying the lubricant are spaced from the contact position between the rolls, and header covers 42 (described later) and the water wiping plates 6, 7 are provided, lubrication between the work rolls 102 and the back-up rolls 103 can be reliably performed without being affected by the cooling water.

Figure 3:
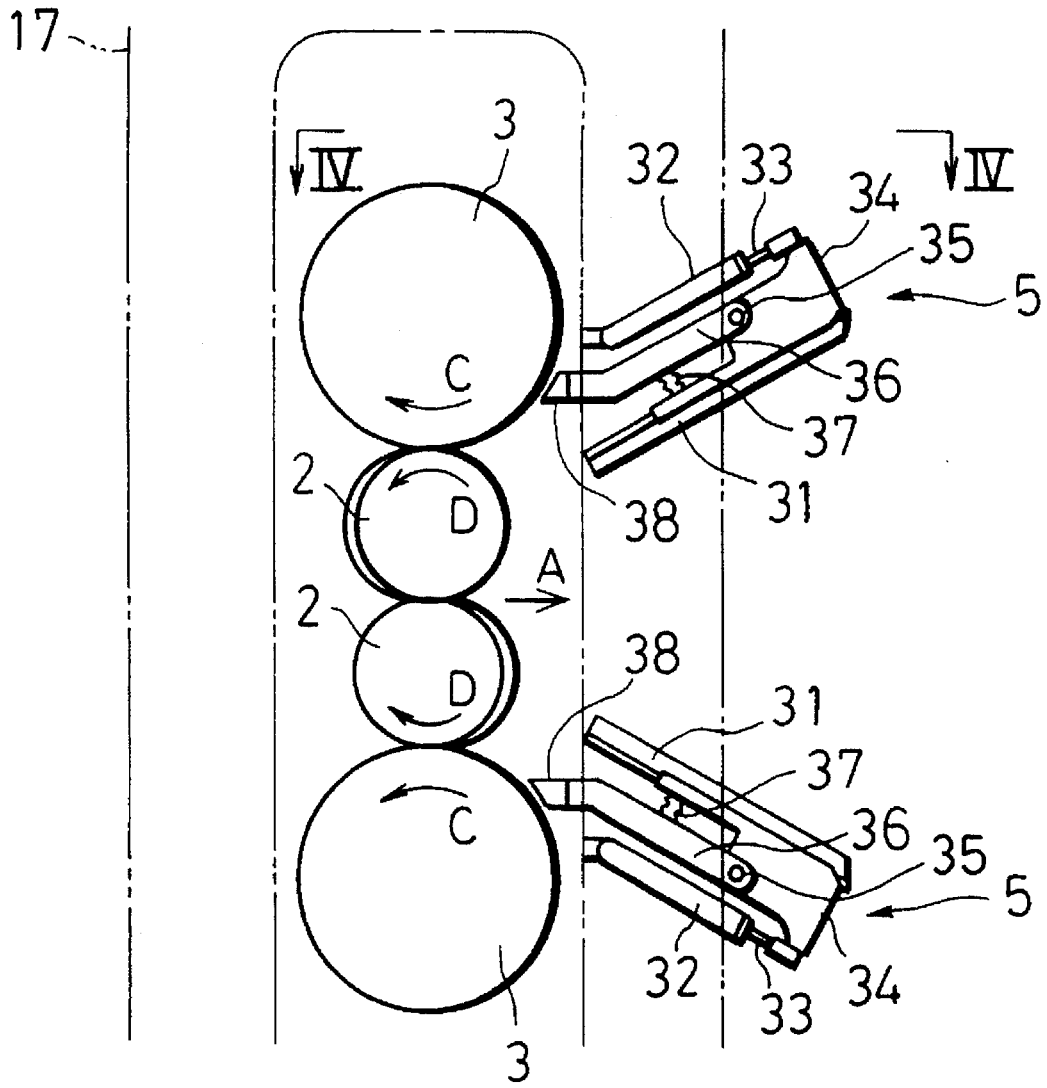
FIG. 3 is a view showing the construction of a lubricant supply unit provided in the mill of FIG. 1.
Figure 4:
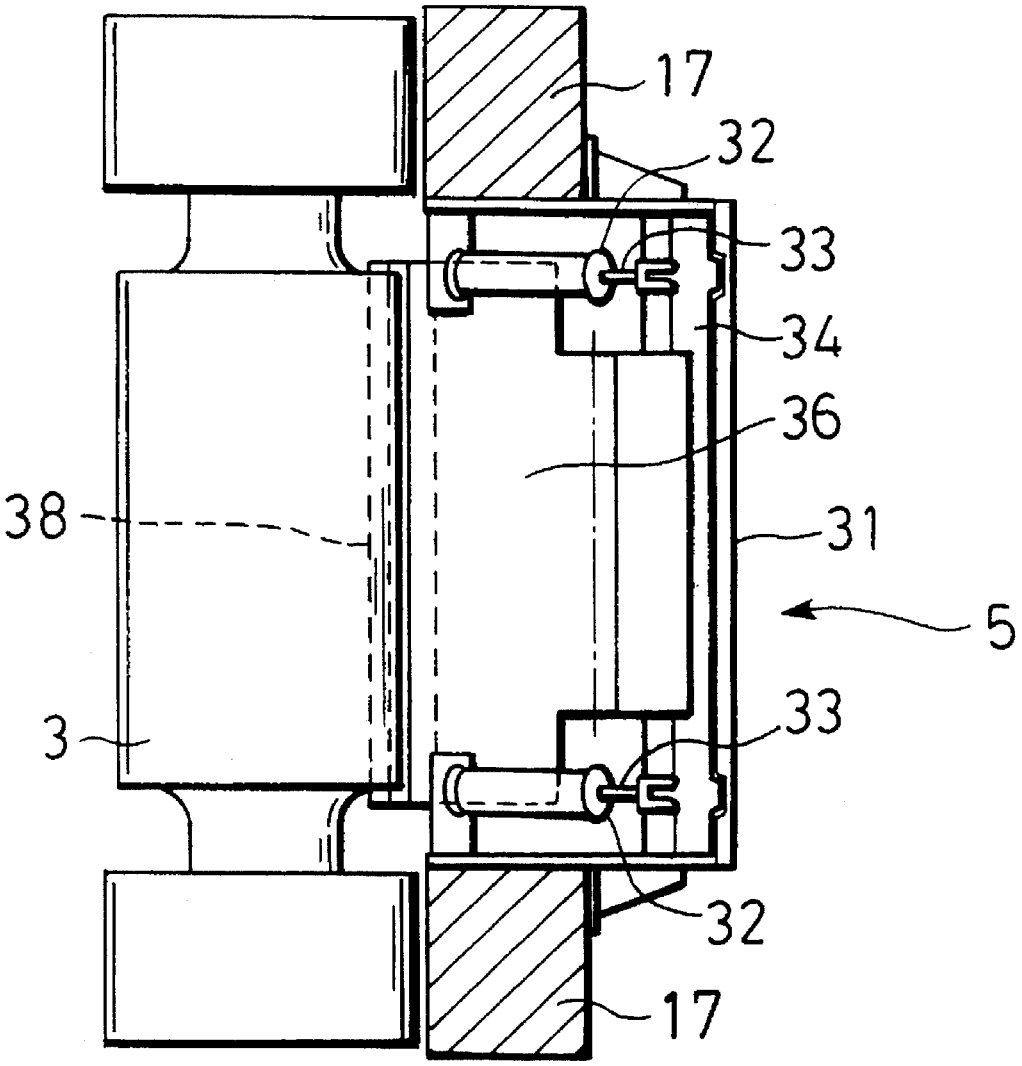
FIG. 4 is a view as viewed in a direction of IV—IV in FIG. 3.

The construction of each lubricant supply unit will be described below with reference to FIGS. 3 and 4. Note that, in FIGS. 3 and 4, the cooling headers 4 and the water wiping plates 6, 7 are omitted. As shown in FIGS. 3 and 4, the lubricant supply unit 5 is disposed in contact with the surface of the back-up roll 3 on the exit side of the mill, and comprises a slide guide 31 and hydraulic cylinders 32 both fixed to a rolling stand 17, a frame 34 slidable over the slide guide 31 connected to pistons 33 which are accommodated in the hydraulic cylinders 32, a header block 36 coupled to the frame 34 by a pivot 35 and being movable together with the frame 34, a spring 37 for urging the header block 36 toward the back-up roll, and a header 38 attached to a distal end of the header block 36 for spraying the lubricant as mentioned above.

The lubricant supply unit 5 is provided in the mill as follows. The header block 36, hence the header 38, is extended externally through a mill window and arranged in contact with the surface of the back-up roll 3 by supplying a hydraulic fluid to the hydraulic cylinders 32 from a hydraulic fluid source (not shown). The header block 36 is urged by the spring 37 forwardly of the slide guide 31 and, therefore, the header 38 is pressed against the back-up roll 3. The position at which the header 38 is arranged can be changed. Thus, when the diameter of the back-up roll 3 is changed, the position of the header block 36 is adjusted by being moved back and forth corresponding to such a change in the roll diameter.

Figure 5:
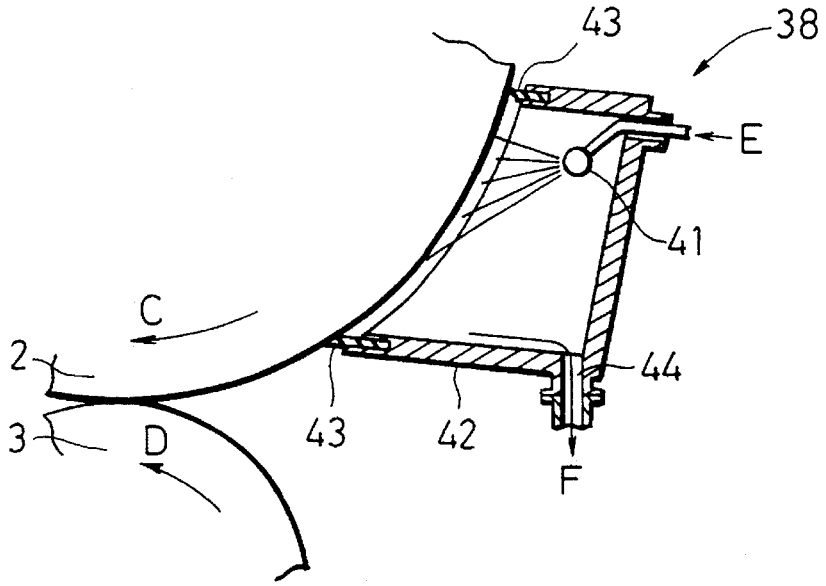
FIG. 5 is a sectional view showing the construction of a header provided in the lubricant supply unit of FIG. 3.

The construction of the header 38 provided in each lubricant supply unit 5 will now be described with reference to FIG. 5. Note that arrows E and F indicate directions in which the lubricant is supplied and returned, respectively. As shown in FIG. 5, the header 38 comprises a lubricant spray nozzle 41 for spraying the lubricant onto the surface of the back-up roll 3, a header cover 42 for confining the lubricant sprayed from the lubricant spray nozzle 41, seal members 43 buried in ends of the header cover 42 facing the back-up roll 3, and an oil return line 44 as a lubricant return passage for returning the surplus lubricant recovered in the header cover 42. The lubricant sprayed from the lubricant spray nozzle 41 and plated out over the surface of the back-up roll is brought into between the work rolls 2 and the back-up rolls 3 for lubricating between the rolls, as explained above. On the other hand, the surplus lubricant having not deposited on the roll and scattered to the surroundings is recovered by the header cover 42 and returned to the lubricant reservoir 21 (see FIG. 1) through the oil return line 44.

The header cover 42 serves to prevent the sprayed lubricant from scattering out of the same, and also prevent the cooling water from entering it externally. The seal members 43 are made of flexible material such as rubber, for example, and serve as contact type seal means coming into abutment against the back-up roll 3 for thereby sealing the interior of the header cover 42 to prevent the surplus lubricant from leaking to the outside and also prevent the cooling water from entering the header cover 42 from the outside.

Further, the lubricant spray nozzle 41 is designed to be able to spray the lubricant at a pressure higher than 3 $kg/cm^2$. Accordingly, even if the water film is still present on the roll surface in spite of the seal members 43 and the water wiping plates 6, 7, the water film is broken through upon the lubricant sprayed from the lubricant spray nozzle 41 under pressure, so that the lubricant is surely plated out over the roll surface. It is desired that the lubricant spray nozzle 41 be provided in plural number within the header 38 and arranged to make sprays of the lubricant from every adjacent nozzles overlap with each other. By so arranging, the lubricant can be uniformly deposited on the roll surface.

With this embodiment, as described above, since the lubricant is supplied from the headers 38 of the lubricant supply units 5 to the surfaces of the back-up rolls 3 at locations spaced from the contact positions between the work rolls 2 and the back-up rolls 3, the lubricant can surely lubricate between the work rolls 2 and the back-up rolls 3 without being impeded by the cooling water. As a result, the thrust forces produced between the work rolls 2 and the back-up rolls 3 can be effectively reduced.

Also, since the headers 38 each include the header cover 42 for confining the lubricant sprayed from the lubricant spray nozzle 41, an oil return line 44 for returning the surplus lubricant, and the seal members 43 made of flexible material such as rubber, it is possible to prevent the cooling water from mixing into the lubricant sprayed, and also prevent the surplus oil from scattering to the outside. Further, since the water wiping plates 6 and 7 are respectively disposed in contact with the surface of each back-up roll on the strip exit and entrance sides, the lubricant can be reliably plated out without being affected by the cooling water.

With the lubricant spray nozzle 41 spraying the lubricant at a pressure higher than 3 $kg/cm^2$, even if the water films are still present on the roll surfaces in spite of the seal members 43 and the water wiping plates 6, 7, the water films are broken through, thus enabling the lubricant to be surely plated out over the roll surface.

Additionally, since the surplus lubricant recovered is returned to the lubricant reservoir 21 through the oil return line 44 and supplied to the lubricant supply units 5 again for reuse by circulation, the amount of lubricant to be mixed into the cooling water can be reduced and the cooling water mixed with the lubricant can be more easily treated. Since the lubricant is not wasted, lubrication can be achieved with the necessary minimum amount of lubricant. Moreover, any of stable oil and unstable oil may be used as the raw lubricant oil. Even in the case of using stable oil, there is no problem in treating the cooling water mixed with the lubricant.

Figure 6:
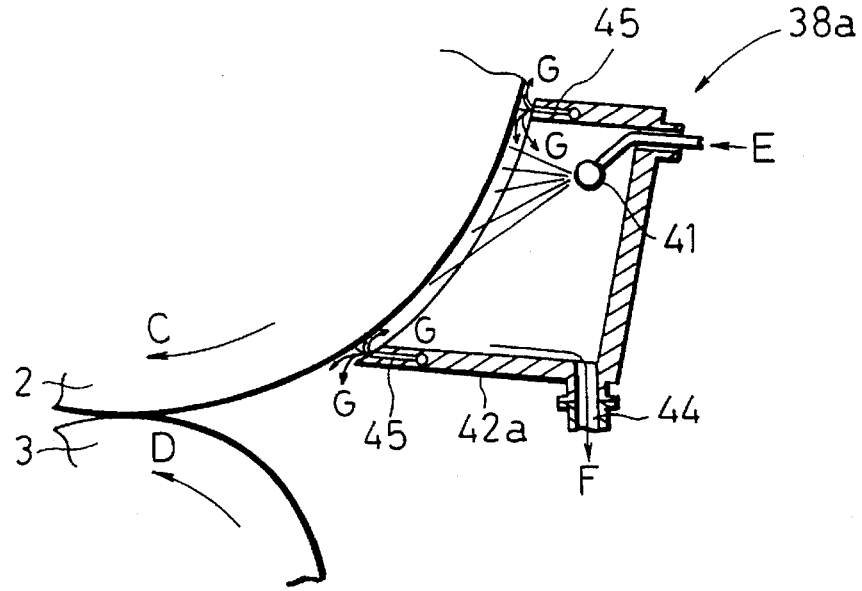
FIG. 6 shows another embodiment of the present invention and is a sectional view showing the construction of a header provided in the lubricant supply unit.

Another embodiment of the present invention will be described below with reference to FIG. 6.

This embodiment is of the same construction as the above embodiment except that the header for spraying the lubricant is provided with different type seal means. More specifically, as shown in FIG. 6, the seal means of this embodiment is of contactless type seal means that high-pressure gas supplied from gas supply means (not shown) is jetted out of slits 45 formed in ends of a header cover **42*a* of a header 38*a* facing the back-up roll 3. Thus, the high-pressure gas jetted out of the slits 45 flows as indicated by arrows G in FIG. 6 to seal the inside of the header cover 42*a* similarly to the aforesaid seal member 43**, making it possible to prevent the surplus lubricant from leaking to the outside and also prevent the cooling water from entering the header cover from the outside. The other advantages are similar to those of the above embodiment.

Still another embodiment of the present invention will be described below with reference to FIGS. 7 and 8. This embodiment is different from the embodiment of FIGS. 1 to 5 in that both end portions of each back-up roll 3 is tapered and the seal means of the header is modified in its configuration correspondingly. Note that, in FIGS. 7 and 8, the cooling headers and the water wiping plates are omitted.

During the rolling, the roll surfaces may be subjected to the Hertz deformation depending on the rolling load and roll bending forces, with the result that the axes of the back-up roll and the work roll approach each other. In such an event, because both end portions of the back-up roll are largely deformed, the seal means (i.e., the seal member 43 in FIG. 3) of the header held in contact with those both roll end portions may no longer properly function. This embodiment is intended to eliminate such a trouble.

Figure 7A:
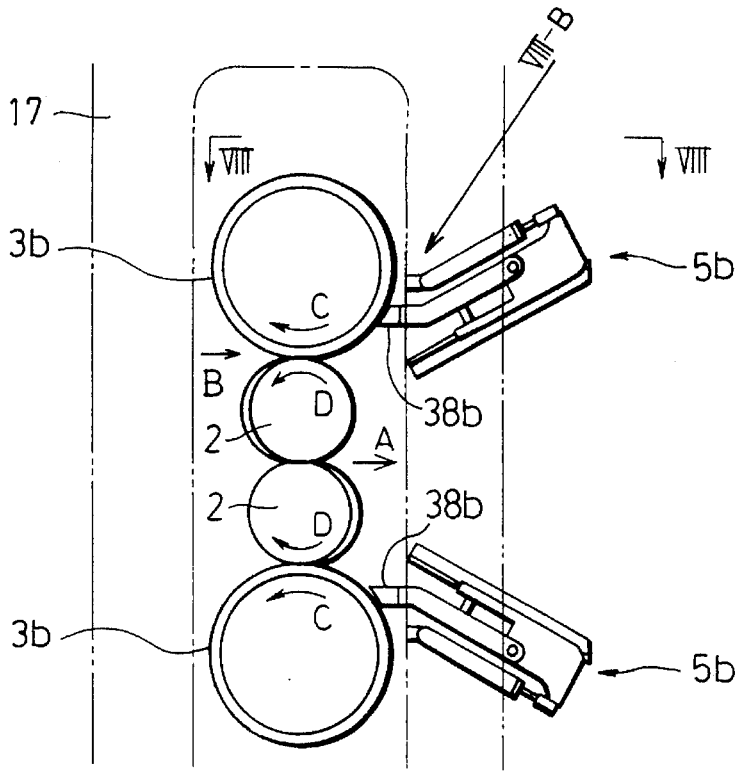
FIG. 7A is a view showing the construction of a mill and a lubricant supply unit provided in the mill.
Figure 7B:
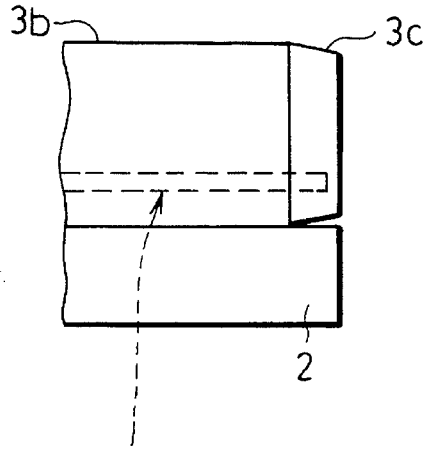
FIG. 7B is a partial view as viewed in a direction of B in FIG. 7A.
Figure 8A:
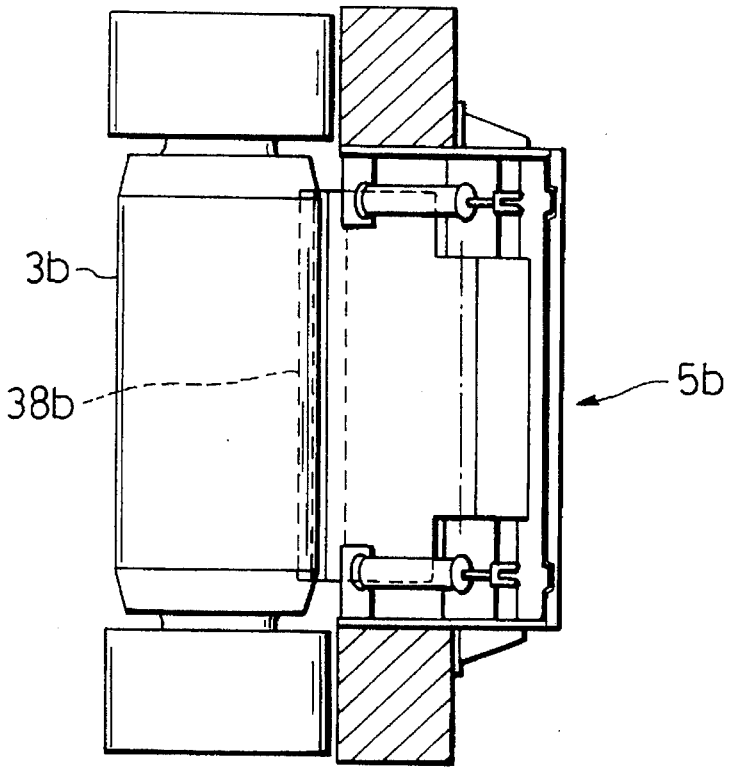
FIG. 8A is a view as viewed in a direction of VIII–VIII in FIG. 7A
Figure 8B:
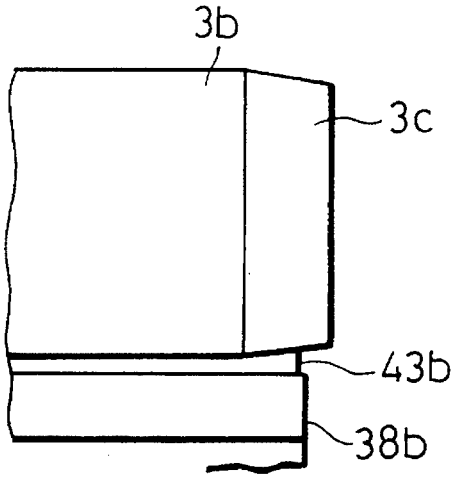
FIG. 8B is a partial view as viewed in a direction of VIII–B in FIG. 7A.

More specifically, as shown in FIGS. 7A and 7B, both end portions of each back-up roll **3*b* are tapered at 3*c* so that the tapered portions 3*c* will not contact the surface of the work roll 2 even when the roll surfaces are subjected to the Hertz deformation and the axes of the back-up roll and the work roll approach each other, as mentioned above. Also, as shown in FIGS. 8A and 8B, a seal member 43*b* of a header 38*b* in a lubricant supply unit 5*b*, which comes into contact with the tapered portions 3*b*, is configured in match with the tapered portions 3*c* to keep contact relation therebetween. By so modifying, the tapered portions 3*c* will not largely deform because of not contacting the surface of-the work roll 2 even in case of the Hertz deformation, whereby the seal member 43*b* configured in match with the tapered portions 3*c*** to keep contact relation continues functioning as the seal means.

With this embodiment, as described above, in addition to the similar advantages to those of the above embodiment shown in FIGS. 1 to 4, there is obtained another advantage that the seal member **43*b*** can continue fulfilling its function even when the roll surface is subjected to the Hertz deformation and the axes of the back-up roll and the work roll approach each other.

Figure 9:
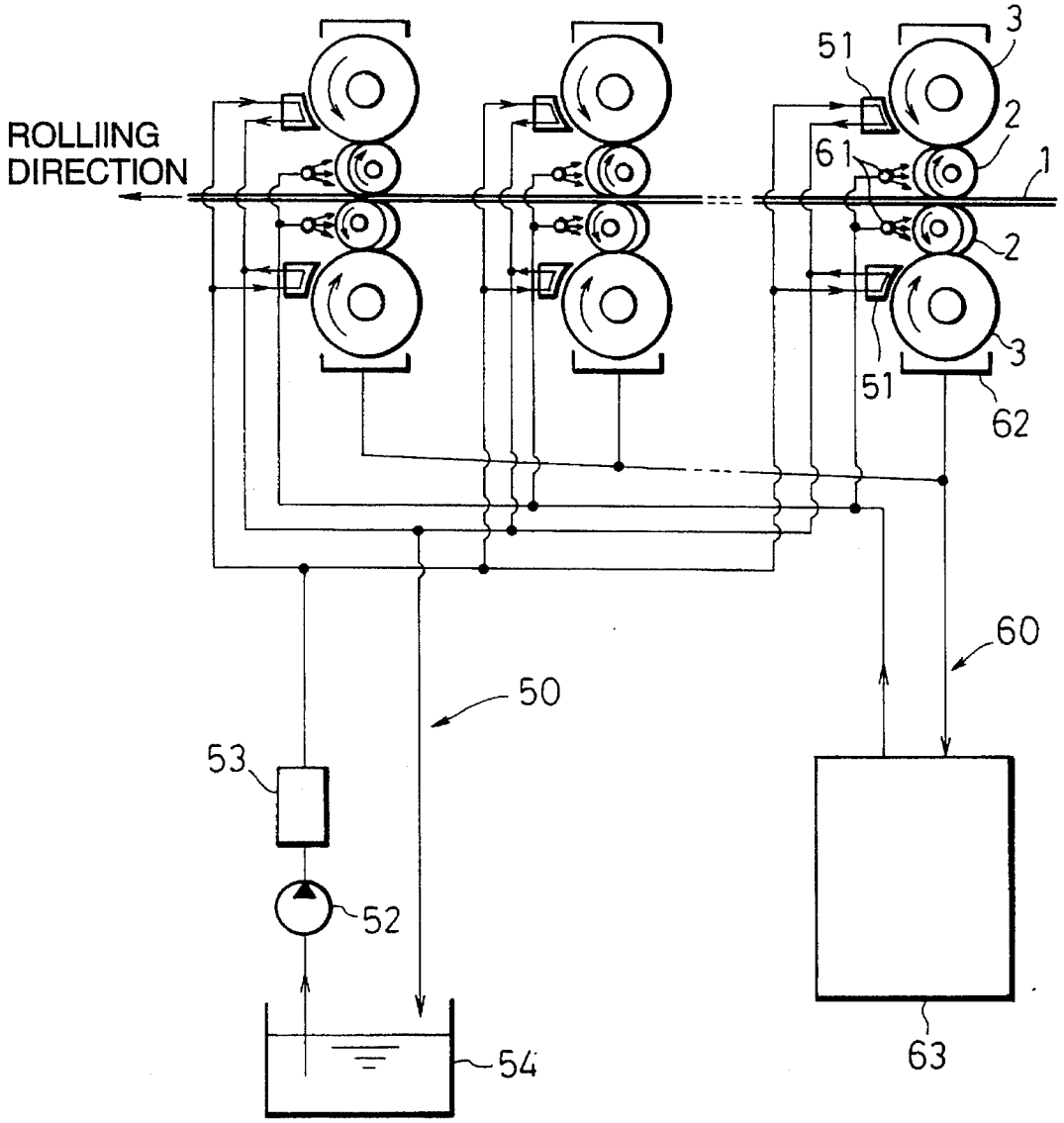
FIG. 9 shows still another embodiment of the present invention and is a diagram showing a rolling system which incorporates the mills of the present invention.

Still another embodiment of the present invention will be described below with reference to FIG. 9. This embodiment is one example of a rolling system incorporating the mills according to any of the above-explained embodiments. Note that, in FIG. 9, the water wiping plates are omitted. As shown in FIG. 9, the rolling system of this embodiment is a hot finishing mill train in which the seven mills 10 are arranged to be capable of tandem-rolling the strip 1. A roll-to-roll lubricant supply system 50 and a roll cooling water supply system 60 are provided as common systems for supplying the cooling water and the roll-to-roll lubricant to all the mills. More specifically, a lubricant supply unit 51 is provided for each back-up roll 3, a cooling water header 61 is provided for each work roll 2, and a pan 62 is provided below each mill 10. The lubricant supply unit 51 is connected to a lubricant reservoir 54 through a pump 52 and a filter 53 for reuse of the lubricant by circulation, while the cooling header 61 and the pan 62 are connected to a water treating equipment 63 which includes a water cooling tank, a pump and a water treating apparatus. The rolling system functions similarly to the above-mentioned mill and can provide the similar advantages.

In this embodiment, the seven mills are all constituted by the work rolls crossing type mills of the above-explained embodiment. It is, however, also possible to constitute at least one of the seven mills by the work rolls crossing type mill of the above-explained embodiment and others by the conventional mills.

Still other embodiments of the present invention will be described below with reference to FIGS. 10 to 14. Note that those components identical to those in FIG. 1 are denoted by the same reference numerals in the following description.

Figure 10:
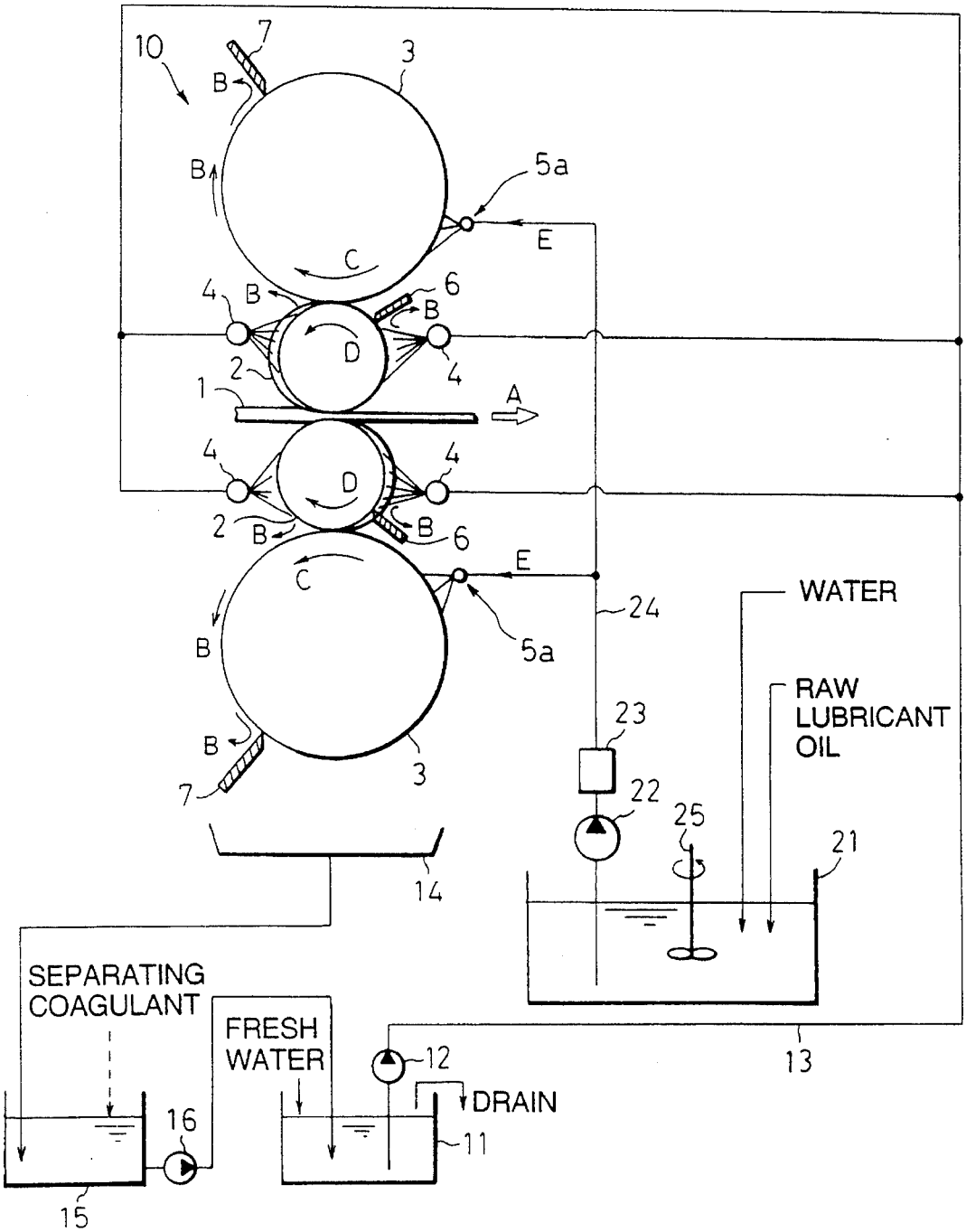
FIG. 10 is a diagram showing still another embodiment of the mill and the rolling method according to the present invention.

As shown in FIG. 10, in a 4-high mill 10, a pair of upper and lower work rolls 2, 2 are arranged such that their roll axes are crossed with respect to axes of a pair of upper and lower back-up rolls 3, 3, respectively, and they are also crossed with respect to each other. By controlling a cross angle between the upper and lower work rolls 2, 2, a strip 1 is rolled while being controlled in its strip crown. The work rolls 2, 2 can be inclined in horizontal planes by a not-shown mechanism with respect to the back-up rolls 3, 3, while making their roll axes crossed each other.

Cooling headers 4 are provided at locations facing the work rolls 2 on the entrance and exit sides of the mill 10, and lubricant spray headers 5*a* are provided along the surfaces of the back-up rolls 3 at locations spaced from the contact positions between the work rolls 2 and the back-up rolls 3. Further, water wiping plates 6 as first water wiping means are provided in contact with the surfaces of the work rolls 2 at locations on the strip exit side just before the contact positions between the work rolls 2 and the back-up rolls 3, and water wiping plates 7 as second water wiping means are provided in contact with the surfaces of the back-up rolls 3 on the strip entrance side. In FIG. 10, an arrow A indicates a direction of advance of strips, an arrow B a direction in which cooling water is sprayed, and arrows C, D directions of rotation of the back-up rolls 3 and work rolls 2, respectively.

The cooling headers 4 are supplied with the cooling water sent from a cooling water reservoir 11 by a pump 12 through a line 13, and the cooling water is sprayed from the cooling headers 4 for cooling the work rolls 2, 2. The cooling water that has a raised -temperature and contains a large amount of scales or iron after cooling the work rolls 2 is collected into a pan 14 disposed below the mill along with hot rolling oil, a lubricant for between the rolls and/or oil coming out of the mill, and then sent to a water treating apparatus 15. The treated water is sent by a pump 16 to be stored in the cooling water reservoir 11 again for reuse by circulation. The water in the cooling water tank 11 is drained at a constant flow rate (e.g., 50 $m^3$/hr), while fresh water is resupplied at a constant flow rate (e.g., 50 $m^3$/hr) corresponding to the flow rate of the water drained.

The lubricant spray headers 5*a* are supplied with a lubricant pumped up by a pump 22 and sent from a lubricant reservoir 21 through a line 24 after impurities such as dusts have been removed away by a filter 23. The lubricant is then sprayed from the lubricant spray headers 5*a* onto the surfaces of the back-up rolls 3. The locations of spraying the lubricant are along the surfaces of the back-up rolls 3 and spaced from the contact positions between the work rolls 2 and the back-up rolls 3. Those spraying locations are substantially the same as positions where the lubricant supply units 5 in FIG. 5 are provided. With rotation of the back-up rolls 3, the lubricant plated out over the roll surfaces is brought into the contact positions between the work rolls 2 and the back-up rolls 3 for lubricating between the rolls.

The locations of spraying the lubricant are spaced from the contact positions between the work rolls 2 and the back-up rolls 3, as mentioned above, and are set to such a distance that the lubricant is surely plated out over the surfaces of the back-up rolls 3 without being impeded by the cooling water, even if the cooling water is gathered between the work rolls 2 and the back-up rolls 3. With rotation of the back-up rolls 3, the plated-out lubricant is brought into the contact positions between the work rolls 2 and the back-up rolls 3, thereby lubricating between the rolls.

In this embodiment, because the lubricant spray headers 5*a* are not provided with the header covers 42 as shown in FIG. 1, most of the lubricant after lubricating between the rolls is collected into the pan 14 below the mill and sent to the water treating apparatus 15 for treatment, as mentioned above. However, the raw lubricant oil used in this embodiment is highly separable from water, as described later; hence the cooling water can be easily treated by using a separating coagulant as usual.

In the lubricant reservoir 21, the raw lubricant oil (described later) and water are mixed at suitable concentration, e.g., 3%, and the mixture or lubricant is always agitated by an agitator 25 to keep a emulsion property. Also, the lubricant reservoir 21 is resupplied with water and the raw lubricant oil corresponding to amounts of consumed for lubrication between the rolls.

Next, the lubricant for use in this embodiment will be described in detail.

Results studied by the inventors on requirements necessary for practicing the work rolls crossing type mill of this embodiment are first summarized below.

(1) Relating to the coefficient of friction between rolls (1)-(a) The coefficient of friction should be not larger than 0.1 from limitation in load capacity of thrust chocks for the work roll;

The thrust load capacity of the work roll chocks is usually 5% of the rolling load at maximum. In the work rolls crossing type mill, since the thrust force imposed on each work roll is given by a difference between the force applied from the back-up roll (corresponding to the above coefficient of friction 0.1) and the force applied from the strip (5% of the rolling load at maximum). Accordingly, if the coefficient of friction between the rolls is not larger than 0.1, the thrust load imposed on the work roll is held not larger than 5% of the rolling load.

(1)-(b) The coefficient of friction should be not smaller than 0.04 so that the back-up roll does not slip during acceleration after biting the strip and during deceleration after passing of the strip;

Because of being driven by the work roll, the back-up roll having large inertia would be likely to slip and cause local wears in its surface if the coefficient of friction between the rolls is too small. While a relatively large force corresponding to the balancing force of the work roll is usually applied to the back-up roll, the coefficient of friction between the rolls not smaller than 0.04 is required to drive the back-up roll even in such a case, taking into account resistance of seals etc. in the back-up roll chocks (corresponding to the coefficient of friction about 0.01), inertial torque necessary for the acceleration (corresponding to the coefficient of friction 0.02 to 0.03), and other factors.

(2) Relating to ability of biting strip

A lubricating ability of the lubricant should be remarkably lowered at a high temperature;

The lubricant having lubricated between the rolls deposits on the work roll surface and impairs the biting ability upon reaching the area where the rolls are biting the strip. In that area, however, the lubricant contacts the strip at a high temperature over 700° C. Accordingly, it is essential for practical use of the work rolls crossing type mill to use the lubricant which loses its lubricating ability at a high temperature.

(3) Relating to vibrations caused by slip speed due to crossing between rolls (3)-(a) The coefficient of friction between the rolls is desirably smaller from the standpoint of preventing vibrations of the rolls;

The roll vibration is attributable to a stick slip with an elastic deformation of the roll surface in the axial direction serving as a spring; hence it is not produced if the coefficient of friction is small (usually not larger than 0.1).

(3)-(b) The strength of oil films of the lubricant is preferably greater from the standpoint of preventing vibrations of the rolls;

The load acting between the rolls is so large that the lubrication between the rolls necessarily takes place as boundary lubrication. The aforesaid stick slip is generated upon the oil films of the lubricant being broken. Accordingly, increasing the strength of the oil films is important for the above purpose of preventing the vibrations.

(4) Relating to axially uniform lubrication on roll surface

The viscosity of the lubricant should be not larger than 80 Cst. at 40° C. (normal temperature);

With the viscosity being smaller, the lubricant is more fluidable, less clogged in the lubricant supply units, and further more uniformly coated over the roll surfaces to thereby provide a more uniformly lubricated condition.

(5) Relating to treatment of cooling water mixed into lubricant

The lubricant mixed into the cooling water should be highly separable;

The lubricant having lubricated between the rolls is necessarily mixed into a large amount of cooling water sprayed to cool the work rolls. The cooling water is always recycled and also always replaced by fresh water while draining a part of the cycled water from the factory correspondingly. Therefore, it is quite important that the cooling water mixed with the lubricant can be easily separated. Conversely, if the lubricant is less separable, a great deal of cost would be needed for the treatment, or the treating apparatus would be large-scaled, making it impracticable to realize the work rolls crossing type mill.

Thus, it has been found that the above requirements necessary for practicing the work rolls crossing type mill can be satisfied by using the raw lubricant oil of the lubricant which meets the following requirements:

(a) the coefficient of friction between the work roll and the back-up roll is in the range of 0.04 to 0.1;

(b) the viscosity is not larger than 80 cSt (centi-stokes) at 40° C.;

(c) mineral oil and synthetic ester not less than 5% are contained as base oil;

(d) a fatty acid in the range of 0.03 to 0.5% is contained as an oiliness enhancer;

(e) an extreme pressure additive not less than 0.1% is contained; and (f) a surface active agent not larger than 0.5% is contained as emulsifier.

These requirements will be described below in relation to the requirements for practicing the present mill.

(1) Relating to the coefficient of friction between rolls

From the limitations on (1)-(a) load capacity of the work roll and (1)-(b) slip prevention of the back-up roll, the coefficient of friction between the rolls is required to be in the range of "0.04 to 0.1".

Figure 11:
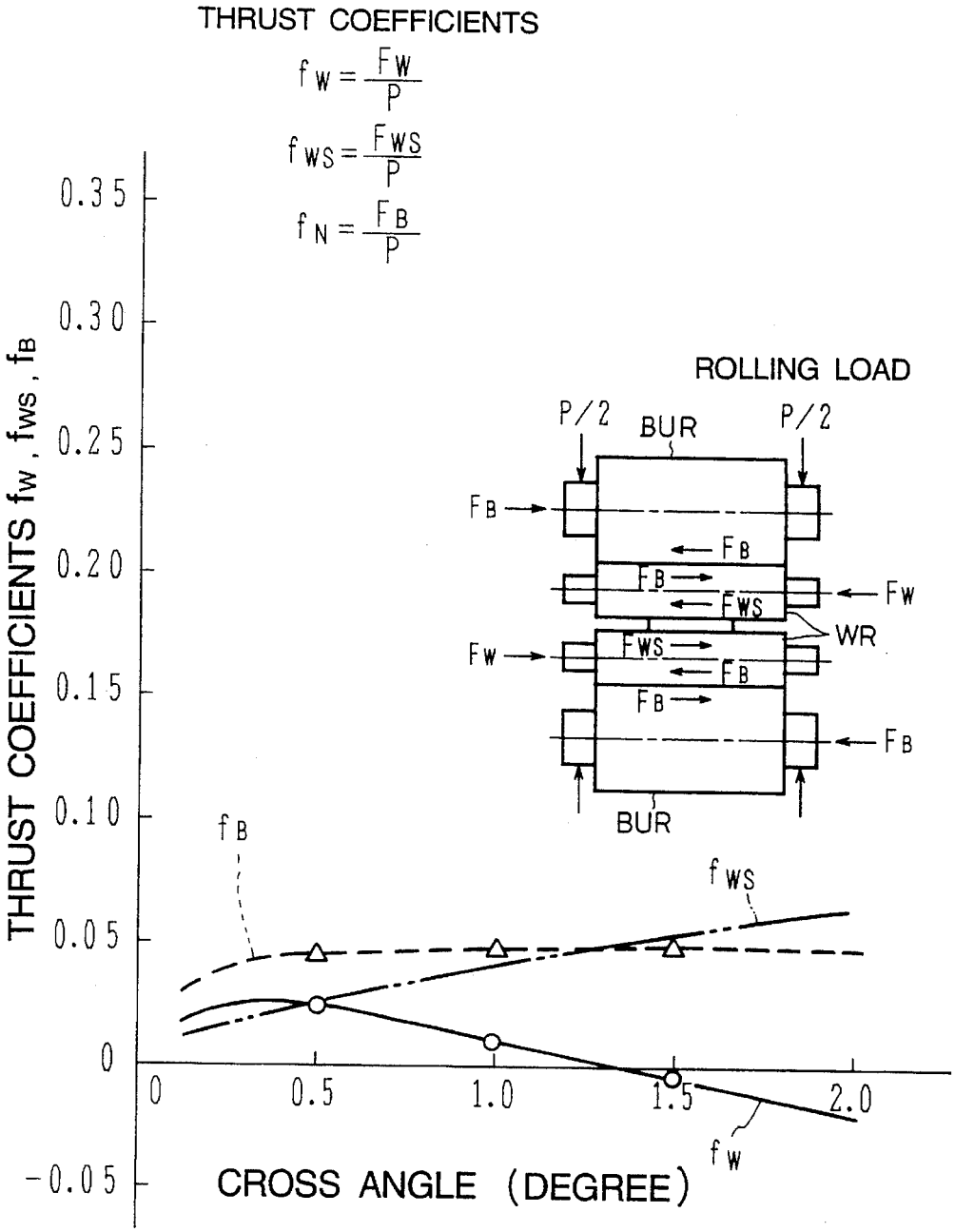
FIG. 11 is a graph showing thrust forces as thrust coefficients produced when a cross angle between work rolls is changed.

A description will now be given of the upper limit of the coefficient of friction between the rolls with reference to FIG. 11. In FIG. 11, $f_B$ is a thrust coefficient representing the thrust force that the work roll receives from the back-up roll, and corresponds to the coefficient of friction between the rolls. Also, $f_{WS}$ is a thrust coefficient representing the thrust force that the work roll receives from the strip, and $f_W$ is a thrust coefficient representing the total thrust force that the work roll receives. Note that FIG. 11 shows, by way of example, the case where the coefficient of friction between the rolls is 0.05.

Applied to the work roll 2 having small load capacity are both the thrust force from the back-up roll 3 and the thrust force from the strip 1. Conveniently, these thrust forces act in opposite direction and, therefore, the total thrust force imposed by the work roll 2 is given a difference between the two thrust forces, as shown in FIG. 11. Thus, $f_W$ is equal to the difference between $f_B$ and $f_{WS}$. Here, the thrust force that the work roll 2 receives from the strip 1 is as high as 5% of the rolling load even when the strip 1 is subjected to the maximum rolling load. In order to hold the total thrust force imposed on the work roll 2 to be not larger than 5% as explained above, therefore, it is required to hold the thrust force that the work roll 2 receives from the back-up roll 3 to be not larger than 10% of the rolling load. Consequently, the coefficient of friction between the rolls is required to be not larger than 0.1.

A description will now be given of the lower limit of the coefficient of friction between the rolls. If the coefficient of friction between the rolls is too small, the rotation of the back-up roll cannot follow the rotation of work roll and hence slip during acceleration after biting the strip and during deceleration after passing of the strip, thereby causing local wears in the surface of the back-up roll. Particularly, such a slip is more likely to occur during deceleration after passing of the strip. The coefficient of friction between the rolls necessary during the acceleration and deceleration of the rolls is expressed by the following equation;

$$\mu = \mu_r + I\left(\frac{d}{dt}\,\omega\right)\frac{1}{QR_B} \tag{1}$$

where $\mu_r$ is the resistance of seals etc. in chocks of the back-up roll, I is the inertial moment of the back-up roll, $\omega$ is the angular speed of rotation of the back-up roll, Q is the force between the work roll 2 and the back-up roll 3 (50 ton or more can be provided in an actual mill), and $R_B$ is the radius of the back-up roll 3.

In the equation (1), the first term in the right side, i.e., $\mu_r$, corresponds to the coefficient of friction 0.01 and the second term represents the inertial torque required for the acceleration. As a result of calculations on an actual mill, the second term corresponds to the coefficient of friction 0.02 to 0.03. Accordingly, the lower limit of the coefficient of friction between the rolls is required to be set to 0.04.

(2) Relating to ability of biting strip

The ability of biting the strip is achieved by meeting the aforesaid requirement (c); i.e., mineral oil and synthetic ester not less than 5% are contained as base oil in the raw lubricant oil. The reason is that, unlike animal and plant oils, the lubricating ability of mineral oil and synthetic ester is remarkably lowered at a high temperature of the strip. Specifically, the lubricant deposited on the work roll surface is brought into the area where the rolls are biting the strip, and comes into contact with the strip at a high temperature not lower than 700° C. At this time, the mineral oil and the synthetic ester are burnt out at such a high temperature and lose most of the lubricating ability, thereby not impeding the biting of-the strip.

Additionally, in the area where the rolls are crossed each other, the temperature is so raised with friction that oiliness provided by only the mineral oil becomes insufficient. By containing synthetic ester not less than 5% as base oil, the deficiency of oiliness in that rolls crossed area is compensated and the above-mentioned coefficient of friction ensured.

(3) Relating to vibrations caused by slip speed due to crossing between rolls

The occurrence of roll vibrations can be prevented by meeting the above requirements (a); but here modified such that the coefficient of friction between the rolls is relatively low, (c); synthetic ester not less than 5% is contained in the raw lubricant oil, (d); a fatty acid in the range of 0.03 to 0.5% is contained as an oiliness enhancer therein, and (e); an extreme pressure additive not less than 0.1% is contained therein. This point will now be described in detail.

Figure 12:
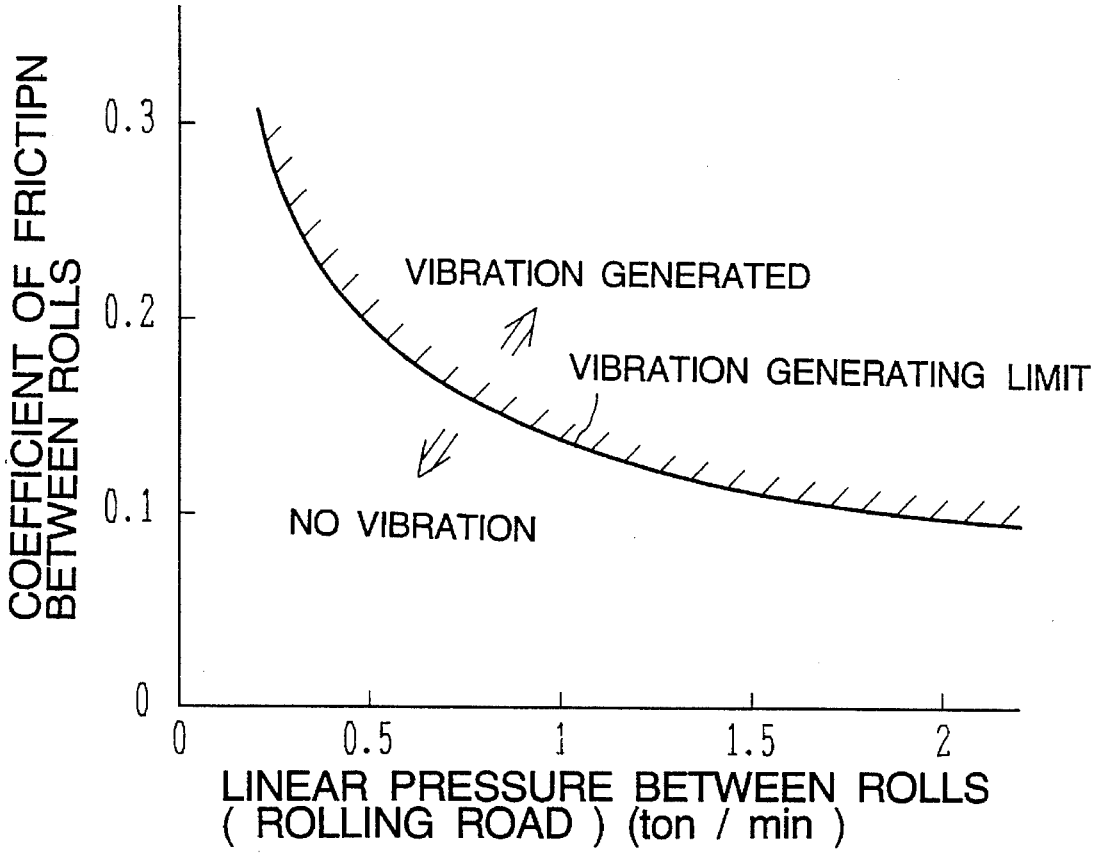
FIG. 12 is a graph of the experimental result showing a vibration generating limit when the coefficient of friction between rolls and a linear pressure between rolls (i.e., a rolling load) are both changed.
Figure 13:
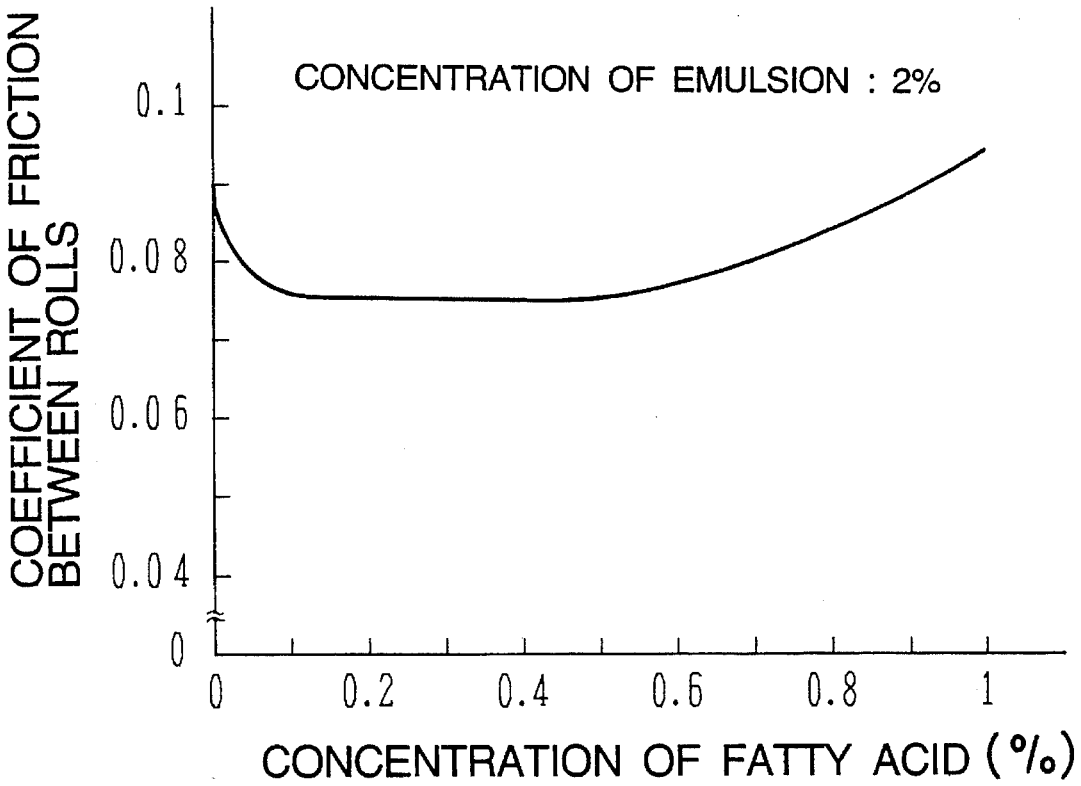
FIG. 13 is a graph showing the relationship between concentration of a fatty acid and the coefficient of friction between rolls in the case of using a lubricant in which an emulsion has concentration of 2%.

As seen from FIG. 12 showing experimental results indicative of a vibration generating limit, if the coefficient of friction between the rolls is relatively reduced, the condition with no vibrations is obtained and the vibrations due to crossing between the work rolls 2 are not produced. Note that FIG. 12 represents the case of using the lubricant in which the raw lubricant oil contains a fatty acid of 0.5%. The vibration generating limit varies depending on the intensity of oil films formed by the lubricant. If the lubricant in which the raw lubricant oil contains no fatty acid is used, the vibrations would be produced even with the ever smaller coefficient of friction between the rolls.

Specifically, the fatty acid contained as an oiliness enhancer reacts with iron and forms strong metallic soap films on the roll surfaces so that the oil films will not break. No breakage of the oil films thus ensured enables prevention of the roll vibrations due to the stick strip.

If the amount of fatty acid exceeds 0.5%, the coefficient of friction between the rolls would be increased with an emulsifying action of the fatty acid. If the amount of fatty acid is too small, i.e., not larger than 0.03%, the coefficient of friction between the rolls would be also increased. In order to ensure the above suitable range of the coefficient of friction, therefore, the optimum amount of fatty acid ranges from 0.03% to 0.5%.

While the area between the work roll and the back-up roll is at a low temperature near the normal temperature as a whole, a part of that area may be locally heated up to above 200° C. due to friction caused by crossing of the rolls so that the aforesaid action of the fatty acid, i.e., the action of increasing the intensity of the oil films to prevent the roll vibrations, is lost. To cope with such a trouble, an extreme pressure additive which has a lubricating ability even above 200° C. is contained in the raw lubricant oil at a ratio not less than 0.1%, preferably about 1%. The extreme pressure additive compensates for the lost effect in the action of the fatty acid to lower the coefficient of friction and contributes to preventing the occurrence of roll vibrations.

(4) Relating to axially uniform lubrication on roll surface

The uniform lubrication can be achieved by meeting the above requirements (b); the viscosity is not larger than 80 Cst. at 40° C., (c); mineral oil and synthetic ester are contained as base oil in the raw lubricant oil, (d); a fatty acid is contained therein, and (f); a surface active agent is contained therein. This point will now be described in detail.

As oil used as hot rolling oil at present, there are known, for example, animal and plant oils (fats and fatty oils) that have a lubricating ability even at a high temperature. However, that type oil has viscosity higher than 100 Cst. at 40° C. (normal temperature) and is very poor in fluidity. Accordingly, that type oil is supplied while heating the lubricant reservoir and the supply pipes to increase the fluidity, but it is often clogged in the pipes and so on. Further, because of being also poor in fluidity on the roll surface, that type oil cannot be distributed in the widthwise direction, resulting in a trouble of lubrication failure. As a result of conducting experiments on requirements necessary for keeping fluidity, it has been confirmed that the above troubles can be avoided if the raw lubricant oil contains, as base oil, mineral oil and synthetic ester and has the viscosity not larger than 80 Cst. at 40° C. (normal temperature).

The fatty acid of (d) has an emulsifying action with which the lubricant is homogenized. Thus, the fatty acid also contributes to uniformly coating the lubricant over the roll surface in the axial direction and providing a uniformly lubricated condition. By mixing the surface active agent as an emulsifier, homogeneity of the lubricant is further improved, enabling the roll surface to be more uniformly lubricated in the axial direction.

With regard to the fatty acid of (d), as mentioned above, the optimum amount of fatty acid for ensuring the above suitable range of the coefficient of friction ranges from 0.03% to 0.5%. If the surface active agent is too much, the coefficient of friction between the rolls would be increased as with the fatty acid. Therefore, the amount of surface active agent is also desirably held down not larger than 0.5% as with the fatty acid.

(5) Relating to treatment of cooling water mixed into lubricant

This treatment can be achieved by meeting the above requirements (d); a fatty acid not larger than 0.5% is contained in the raw lubricant oil, and (f); a surface active agent not larger than 0.5% is contained therein.

A fatty acid has an emulsifying action as mentioned above. Therefore, if the lubricant contains too much fatty acid, it would become less separable from the cooling water. By holding the fatty acid down not larger than 0.5%, emulsification of the lubricant mixed into the cooling water is suppressed to keep so good separability that the oil component in the cooling water can be easily removed by usual treatment employing a separating coagulant. This equally applies to the surface active agent; hence the amount of surface active agent is also desirably held down not larger than 0.5% as with the fatty acid. In other words, the fatty acid and the surface active agent are effective in preparing a uniform emulsion, but reduce separability of the lubricant mixed into the cooling water if added excessively. Thus, the fatty acid and the surface active agent are limited to be not larger than 0.5%.

A description will now be given of one example of the lubricant used for the experiments in this embodiment. In consideration of the above results of studies, the following raw lubricant oil was used in this embodiment.

Base oil: mineral oil (paraffin-base) of 82% and synthetic ester of 15%

Fatty acid (oleic acid): 0.5%

Extreme pressure additive: 1.0%

Surface active agent (emulsifier): None

Others (e.g., antioxidant): 1.5%

The above raw lubricant oil was mixed to water and supplied as a 3% emulsion for rolling a hot strip at temperature not lower than 900° C. with the cross angle between the work rolls being in the range of 0.5° to 1.5°. The results obtained thus rolling the hot strip was below.

Coefficient of friction between rolls: 0.045 to 0.07

Coefficient of biting friction: not smaller than 0.2

Roll vibrations: no vibrations at rolling load (linear pressure between rolls) of 2 ton/mm Here, the coefficient of biting friction indicates the coefficient of friction produced when the rolls are biting the strip end, and was calculated using the equation below:

$$\mu_b = \sqrt{\frac{1}{R}\left(\Delta H + \frac{P}{K}\right)} \tag{2}$$

where $\mu_b$ is the coefficient of biting friction, R is the radius (mm) of the work roll 2, ΔH is the depression amount (mm), P is the rolling load (ton), and K is the mill rigidity (ton/mm).

Accordingly, with this embodiment, it is possible to ensure the ability of biting the strip while reducing the thrust forces between the rolls, and also prevent the occurrence of roll vibrations, enabling the stable operation of the work rolls crossing type mill. Further, the treatment of the cooling water mixed with the lubricant is facilitated. In addition, the easier treatment of the coolings water is effective in not only easily installing a new work rolls crossing type mill, but also easily modifying any existing mill into the work rolls crossing type mill.

Figure 14:
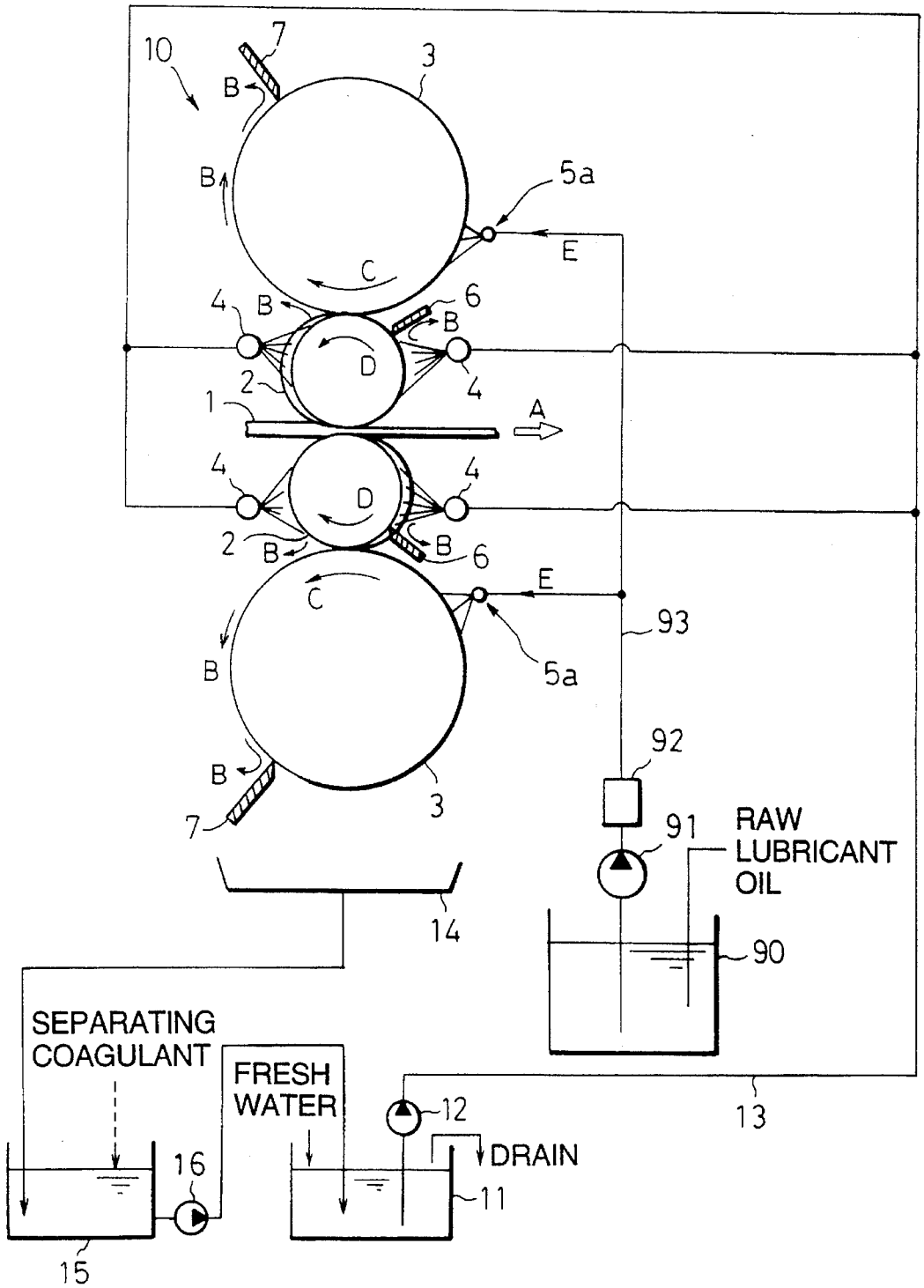
FIG. 14 is a diagram showing still another embodiment of the mill and the rolling method according to the present invention.

Next, still another embodiment of the present invention will be described with reference to FIG. 14.

In this embodiment, the raw lubricant oil is not mixed to water to form an emulsion, but is directly supplied to the surfaces of the back-up rolls 3. In FIG. 14, the raw lubricant oil stored in a lubricant reservoir 90 is pumped up by a pump 91 and sprayed from lubricant spray headers 5*a* through a line 93 after impurities such as dusts have been removed away by a filter 92. Also, the lubricant reservoir 90 is resupplied with the raw lubricant oil in an amount consumed for lubricating between the rolls. The other construction and the requirements to be met by the raw lubricant oil are the same as those in the embodiment of FIG. 10. Those components identical to those in FIG. 10 are denoted by the same reference numerals.

With this embodiment thus constructed, in addition to the similar advantages to those of the above embodiment explained with reference to FIGS. 10 to 13, there is obtained another advantage that since the raw lubricant oil is directly used as the lubricant, the amount of lubricant supplied from the pump 91 to the lubricant spray headers 5*a* is much smaller than the case of supplying the lubricant as an emulsion.

Figure 15:
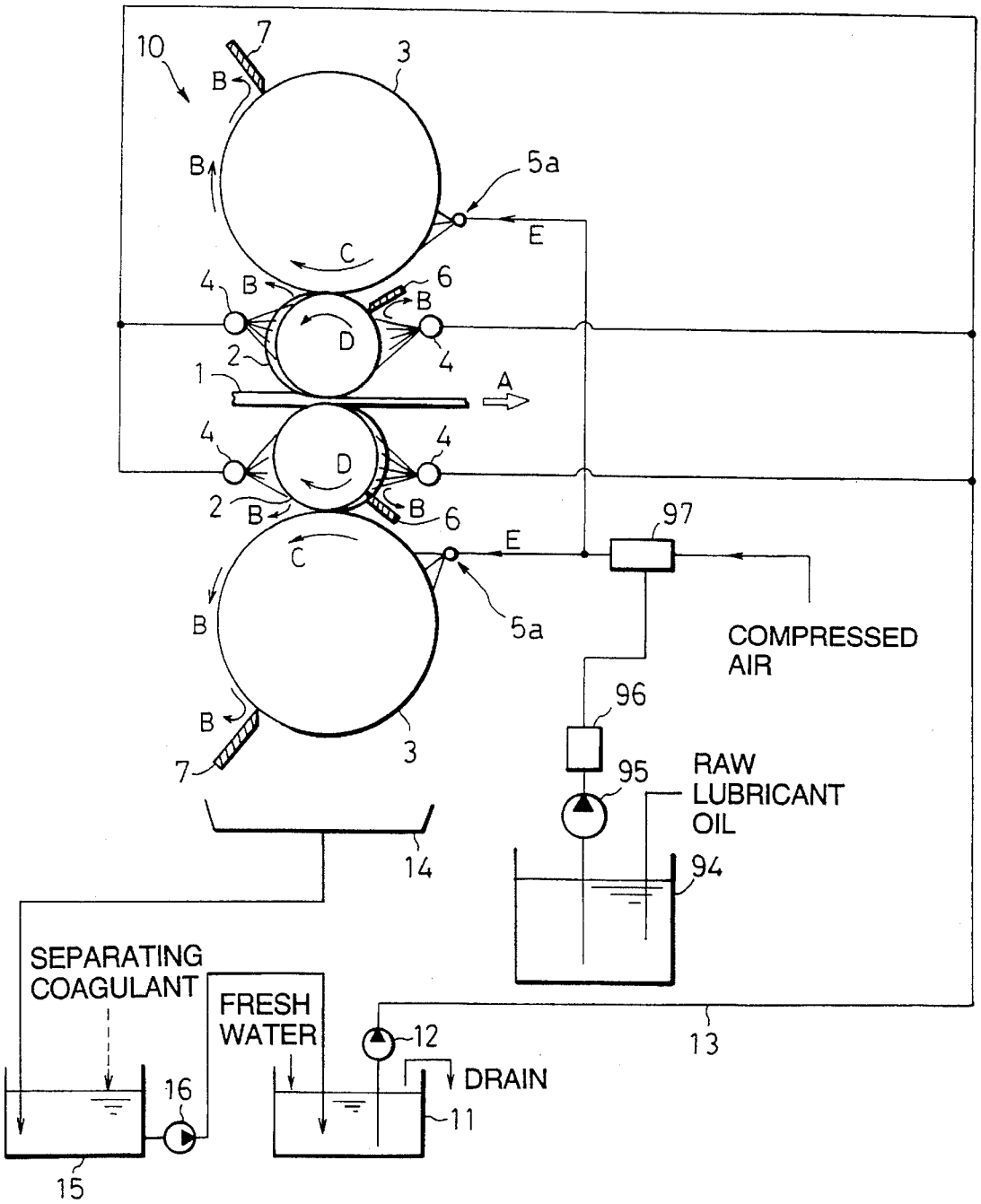
FIG. 15 is a diagram showing still another embodiment of the mill and the rolling method according to the present invention.

Still another embodiment of the present invention will now be described with reference to FIG. 15.

In this embodiment, the raw lubricant oil is mixed with compressed air and then sprayed onto the surfaces of the back-up rolls 3. In FIG. 15, the raw lubricant oil stored in a lubricant reservoir 94 is pumped up by a pump 95 and sent to a mixer 97 after impurities such as dusts have been removed away by a filter 96. Compressed air is also sent to the mixer 97 where the raw lubricant oil and the compressed air are mixed with each other. The raw lubricant oil mixed with the compressed air is sent to lubricant spray headers 5*a* through a line 98 and then sprayed from the lubricant spray headers 5*a*. Also, the lubricant reservoir 94 is resupplied with the raw lubricant oil in an amount consumed for lubricating between the rolls. The other construction and the requirements to be met by the raw lubricant oil are the same as those in the embodiment of FIG. 10. Those components identical to those in FIG. 10 are denoted by the same reference numerals.

With this embodiment thus constructed, in addition to the similar advantages to those of the above embodiment explained with reference to FIG. 14, there is obtained another advantage that since the raw lubricant oil is sprayed by utilizing the compressed air, the raw lubricant oil can be surely plated out over the surfaces of the back-up rolls 3 by breaking through the water films present on the roll surfaces.

An embodiment in which the strip crown of a strip to be rolled is controlled by regulating both an inclination of the work roll and a shift amount of the work roll in the roll axial direction will be described below with reference to FIG. 16.

Figure 16:
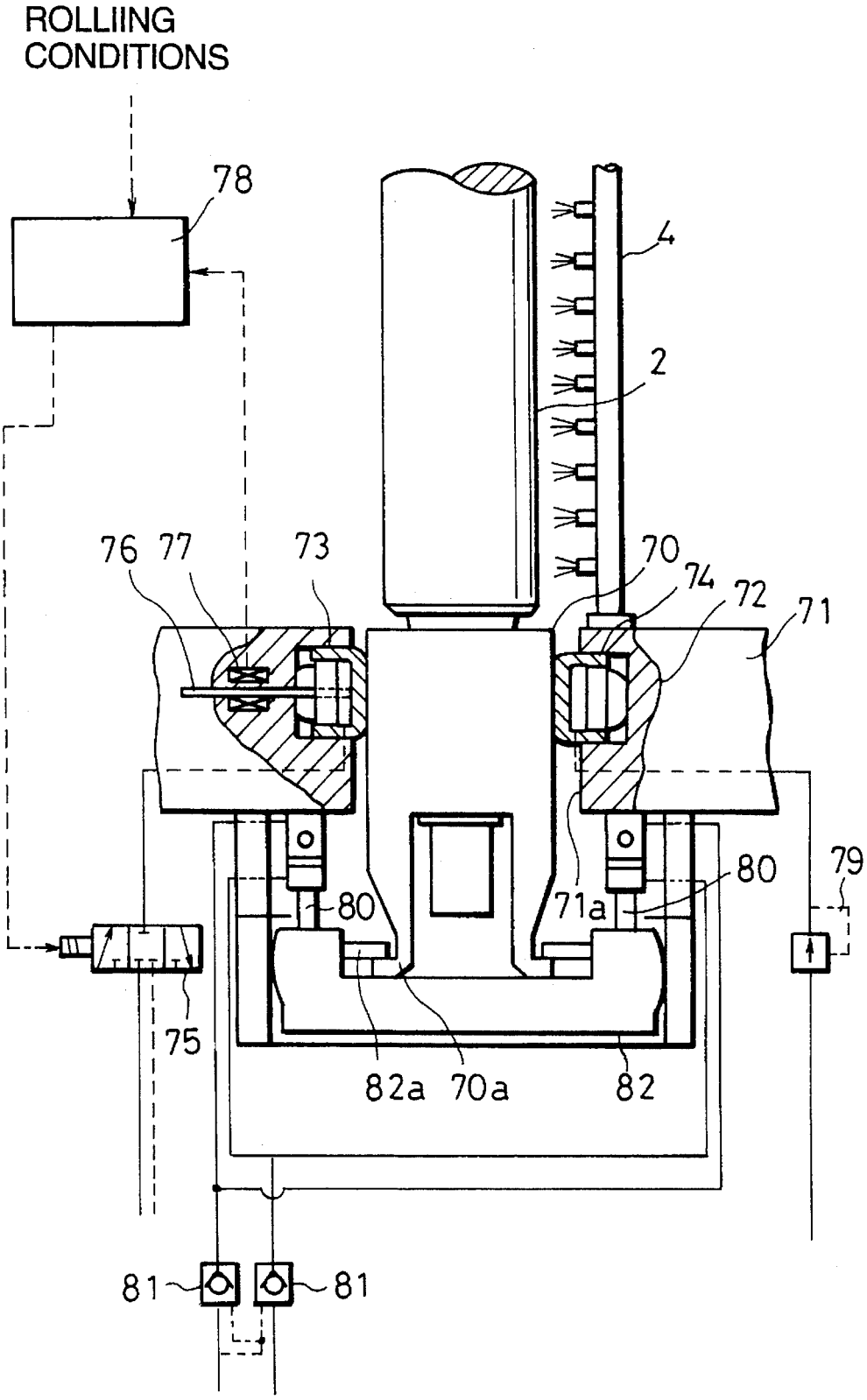
FIG. 16 is a view for explaining still another embodiment of the present invention provided with a mechanism for making work rolls crossed with respect to each other and a mechanism for shifting the work rolls in the roll axial directions.

In FIG. 16, work roll chocks 70 are provided at respective roll ends of upper and lower work rolls 2 for rotatably supporting the upper and lower work rolls 2. The work roll chocks 70 are disposed to face window surfaces 71*a* of a pair of stands 71 which are vertically installed to be spaced from each other in the roll axial direction of the mill.

In order to that roll axes of the upper and lower work rolls 2, 2 are crossed to roll axes of upper and lower back-up rolls 3, 3, respectively, and they are also crossed each other, hydraulic jacks 73, 74 are respectively provided in opposite projecting blocks 72 of the stand 71. Thus, by operatively driving both the hydraulic jacks 73, 74, the associated work roll chock 70 is inclined to make the upper and lower work rolls 2 crossed each other.

A hydraulic fluid is supplied to the hydraulic jack 73 through a directional control valve 75, and the shift amount of a hydraulic ram of the hydraulic jack 73 is detected by a sensor 77 through the displacement amount of a rod 76 attached to the hydraulic ram. The directional control valve 75 is adjusted by a work rolls crossing angle controller 78 based on a signal depending on rolling conditions for driving the hydraulic jack 73, and feedback control is made by using a signal from the sensor for controlling a cross angle between the upper and lower work rolls to a desired value. Also, the hydraulic jack 74 is supplied with the hydraulic fluid via a pressure reducing valve 79 so that the work roll chock 70 is pressed by a required pressing force. The cross angle can be changed even during the rolling, i.e., under the condition that a huge rolling load is applied.

Further, in order to that the upper and lower work rolls 2 can be shifted in the roll axial directions, two hydraulic cylinders 80 operatively driven along the work roll axes are also provided in the stand 71. The hydraulic cylinders 80 are positioned to sandwich the work roll chock 70 therebetween. The hydraulic fluid is always confined in the hydraulic cylinders 80 through respective pilot check valves 81 for holding the current positions. Both rods of the hydraulic cylinders 80 are coupled to a common movable block 82, and engaging portions 82*a* detachably attached to the movable block 82 engage projections 70*a* formed at an end of the work roll chock 70, thereby transmitting drive forces of the hydraulic cylinders 80 to the work roll chocks 70 so that each of the upper and lower work rolls 2 can be shifted in the roll axial direction. Though not shown, it is needless to say that the axial shifts of the upper and lower work rolls 2 are also controlled by a shift amount controller depending on rolling conditions.

The mechanism of this embodiment is applicable to all of the above-explained embodiments.

With this embodiment, since the upper and lower work rolls 2 are not only crossed with respect to each other, but also shifted in the roll axial directions, the strip crown can be controlled by adjusting both the angle of inclination of each work roll and the axial shift amount thereof. In addition, since the work rolls are shiftable in the roll axial directions, schedule-free rolling is enabled.

What is claimed is:

1. A work rolls crossing type mill comprising a pair of work rolls, a pair of back-up rolls for respectively supporting said pair of work rolls, and cooling means for spraying a coolant onto said pair of work rolls from an exit or entrance side of said mill for cooling said pair of work rolls, said pair of work rolls being inclined in horizontal planes and arranged such that axes of said pair of work rolls are crossed with respect to axes of said pair of back-up rolls, respectively, and those axes of said pair of work rolls are also crossed with respect to each other, said mill further comprising:

thrust force reducing means for reducing thrust forces exerted on said pair of back-up rolls and pair of work rolls due to rotation thereof while the axes of said work rolls are crossed with respect to each other, said thrust force reducing means including lubricant supply units arranged to respectively face said pair of back-up rolls on the exit side of the mill for spraying a lubricant onto surfaces of said back-up rolls at locations spaced from contact positions between said pair of work rolls and said pair of back-up rolls without being impeded by coolant gathering in the contact positions, thereby lubricating between said work rolls and said back-up rolls.

2. A work rolls crossing type mill according to claim 1, wherein said lubricant supply units each comprise a lubricant spray nozzle for spraying the lubricant to a location on the surface of one of said back-up rolls, a cover arranged to confine the lubricant sprayed from said lubricant spray nozzle for preventing the coolant sprayed onto the associated work rolls from entering the lubricant sprayed locations on the back-up roll surface and for recovering surplus lubricant therein, seal means provided in ends of said cover facing said one back-up roll for sealing an inside of said cover from the coolant sprayed onto the work rolls, and a lubricant return passage for returning the surplus lubricant recovered in said cover.

3. A work rolls crossing type mill according to claim 2, wherein said seal means includes a slit for jetting high-pressure gas onto said one back-up roll.

4. A work rolls crossing type mill according to claim 2, wherein said seal means includes a flexible material coming into contact with said one back-up roll.

5. A work rolls crossing type mill according to claim 4, wherein said pair of back-up rolls are each tapered at both end portions so that these tapered portions will not contact the surface of the corresponding work roll even when the roll surfaces are subjected to Hertz deformation due to a rolling load and roll bending forces and the axis of said one back-up roll and the axis of said work roll supported by said one back-up roll approach each other, and those portions of said seal means facing said tapered portions are configured to match said tapered portions to keep contact relation therebetween.

6. A work rolls crossing type mill according to claim 1, further comprising first water wiping means arranged in contact with surfaces of said work rolls at locations on a strip exit side just before contact positions between said work rolls and said back-up rolls, as viewed in directions of respective rotations of said pair of work rolls, for blocking the coolant so that the coolant sprayed onto said work rolls will not enter said contact positions.

7. A work rolls crossing type mill according to claim 1, further comprising second water wiping means arranged in contact with the surfaces of said pair of back-up rolls for removing the coolant so that the coolant sprayed onto said pair of work rolls, deposited on the work roll surfaces and then carried over with rotations of said work rolls and said back-up rolls will not reach the locations where said lubricant supply units are arranged.

8. A work rolls crossing type mill according to claim 1, wherein the lubricant supplied from said lubricant supply units contains raw lubricant oil based on a mixture of mineral oil and ester and added with necessary minimum amounts of a surface active agent and a fatty acid both acting to improve emulsification.

9. A work rolls crossing type mill according to claim 8 wherein the lubricant supplied from said lubricant supply units is a highly separable emulsion prepared by diluting said raw lubricant oil with water.

10. A work rolls crossing type mill according to claim 1, wherein the lubricant supplied from said lubricant supply units contains raw lubricant oil meeting the following requirements:

(a) the coefficient of friction between said work rolls and said back-up rolls is in the range of 0.04 to 0.1;

(b) the viscosity is not larger than 80 centi-Stokes at 40° C.;

(c) mineral oil and synthetic ester not less than 5% are contained as base oil;

(d) a fatty acid in the range of 0.03 to 0.5% is contained as an oiliness enhancer; and (e) an extreme pressure additive not less than 0.1% is contained.

11. A work rolls crossing type mill according to claim 10, wherein said raw lubricant oil further meets another requirement (f); a surface active agent not larger than 0.5% is contained as emulsifier.

12. A work rolls crossing type mill according to claim 1, wherein the lubricant supplied from said lubricant supply units contains raw lubricant oil based on mineral oil and added with a surface active agent and a fatty acid for improvement of emulsification.

13. A work rolls crossing type mill according to claim 12, wherein the lubricant supplied from said lubricant supply units is a highly emulsifiable and stable emulsion prepared by diluting said raw lubricant oil with water.

14. A rolling system comprising said work rolls crossing type mill according to claim 1, and a lubricant circulating system including a lubricant reservoir for storing surplus lubricant recovered by said lubricant supply units and a pump for supplying the lubricant to said lubricant supply units.

15. A rolling system comprising at least one of said work rolls crossing type mill according to claim 1 installed for tandem-rolling, and a lubricant circulating system including a lubricant reservoir for storing surplus lubricant recovered by said lubricant supply units and a pump for supplying the lubricant to said lubricant supply units.

16. A rolling mill in which a pair of work rolls and a pair of back-up rolls for respectively supporting the work rolls are provided on a rolling stand and said work rolls are arranged such that their axes are inclinable in a horizontal plane such that rolling of a material to be rolled is carried out with the axes of said work rolls crossing each other, wherein said work rolls are supported such that angles of inclination of respective work rolls are controlled with the axes of said work rolls crossing the axes of said back-up rolls and also crossing a line perpendicular to a direction of rolling of said material, wherein a lubricant supply device is provided for supplying a lubricant to a zone between each work roll having its axis crossing the axis of an associated back-up roll and the back-up roll with which said work roll is in direct contact to reduce axial thrust forces acting between respective ones of said back-up roll and work roll, wherein a coolant supply device is provided which includes structure for spraying coolant on said work rolls, and wherein said coolant supply device and lubricant supply device are constructed so as to limit mixing of coolant with the lubricant at locations where the respective ones of back-up roll and work roll are in direct contact with one another, thereby limiting effects of coolant on the thrust reducing action of the lubricant.

17. A rolling method for use in a mill comprising a pair of work rolls and a pair of back-up rolls for respectively supporting said pair of work rolls, comprising the steps of:

spraying a coolant onto said pair of work rolls from an exit or entrance side of said mill for cooling said pair of work rolls;

controlling inclinations of said pair of work rolls in horizontal planes so that axes of said pair of work rolls are crossed with respect to axes of said pair of back-up rolls, respectively, and those axes of said pair of work rolls are also crossed with respect to each other, thereby controlling the strip crown of a strip to be rolled; and simultaneously spraying a lubricant onto a surface of said back-up rolls at locations spaced from contact positions between said pair of work rolls and said pair of back-up rolls without being impeded by coolant gathering in the contact positions to lubricate between said work rolls and said back-up rolls thereby to reduce thrust forces exerted on the back-up rolls and work rolls due to rotation thereof while the axes of said work rolls are crossed with respect to each other.

18. A work rolls crossing type mill comprising a pair of work rolls and a pair of back-up rolls for respectively supporting said pair of work rolls, said pair of work rolls being inclined in horizontal planes and arranged such that axes of said pair of work rolls are crossed to axes of said pair of back-up rolls, respectively, and those axes of said pair of work rolls are also crossed with respect to each other, said mill further comprising:

thrust force reducing means for reducing thrust forces exerted on said pair of back-up rolls and pair of work rolls due to rotation thereof while the axes of said work rolls are crossed with respect to each other, said thrust force reducing means including lubricant supply units for supplying a lubricant to between said pair of work rolls and said pair of back-up rolls on an exit side of the mill, said lubricant containing raw lubricant oil meeting the following requirements:

(a) the coefficient of friction between said work rolls and said back-up rolls is in the range of 0.04 to 0.1;

(b) the viscosity is not larger than 80 centi-Stokes at 40° C.;

(c) mineral oil and synthetic ester not less than 5% are included as base oil;

(d) a fatty acid in the range of 0.03 to 0.5% is included as an oiliness enhancer; and (e) an extreme pressure additive not less than 0.1% is included.

19. A work rolls crossing type mill according to claim 18 wherein said raw lubricant oil further meets another requirement (f); a surface active agent not larger than 0.5% is contained as emulsifier.

20. A work rolls crossing type mill comprising a pair of work rolls and a pair of back-up rolls for respectively supporting said pair of work rolls, said pair of work rolls being inclined in horizontal planes and arranged such that axes of said pair of work rolls are crossed with respect to axes of said pair of back-up rolls, respectively, and those axes of said pair of work rolls are also crossed with respect to each other, said pair of work rolls being further able to shift in respective roll axial directions, said mill further comprising:

thrust force reducing means for reducing thrust forces exerted on said pair of back-up rolls and pair of work rolls due to rotation thereof while the axes of said work rolls are crossed with respect to each other, said thrust force reducing means including lubricant supply units for supplying a lubricant to between said pair of work rolls and said pair of back-up rolls on the exit side of the mill, said lubricant containing raw lubricant oil meeting the following requirements:

(a) the coefficient of friction between said work rolls and said back-up rolls is in the range of 0.04 to 0.1;

(b) the viscosity is not larger than 80 centi-Stokes at 40° C.;

(c) mineral oil and synthetic ester not less than 5% are included as base oil;

(d) a fatty acid in the range of 0.03 to 0.5% is included as an oiliness enhancer; and (e) an extreme pressure additive not less than 0.1% is included.

21. A rolling method for use in a mill comprising a pair of work rolls and a pair of back-up rolls for respectively supporting said pair of work rolls, comprising the steps of:

spraying a coolant onto said pair of work rolls from an exit or entrance side of said mill for cooling said pair of work rolls;

controlling inclinations of said pair of work rolls in horizontal planes so that axes of said pair of work rolls are crossed with respect to axes of said pair of back-up rolls, respectively, and those axes of said pair of work rolls are also crossed with respect to each other, thereby controlling the strip crown of a strip to be rolled;

simultaneously spraying a lubricant to between said pair of work rolls and said pair of back-up rolls on the exit side of the mill to lubricate between said work rolls and said back-up rolls thereby to reduce thrust forces exerted on the back-up rolls and work rolls due to rotation thereof while the axes are crossed with respect to each other; and using, as said lubricant, raw lubricant oil meeting the following requirements or an emulsion of said raw lubricant oil:

(a) the coefficient of friction between said work rolls and said back-up rolls is in the range of 0.04 to 0.1;

(b) the viscosity is not larger than 880 centi-Stokes at 40° C.;

(c) mineral oil and synthetic ester not less than 5% are included as base oil;

(d) a fatty acid in the range of 0.03 to 0.5% is included as an oiliness enhancer; and (e) an extreme pressure additive not less than 0.1% is included.

22. A rolling method according to claim 21, wherein said raw lubricant oil further meets another requirement (f); a surface active agent not larger than 0.5% is contained as emulsifier.

23. A rolling method for use in a mill comprising a pair of work rolls and a pair of back-up rolls for respectively supporting said pair of work rolls, comprising the steps of:

spraying a coolant onto said pair of work rolls from an exit or entrance side of said mill for cooling said pair of work rolls;

controlling inclinations of said pair of work rolls in horizontal planes so that axes of said pair of work rolls are crossed with respect to axes of said pair of back-up rolls, respectively, and those axes of said pair of work rolls are also crossed with respect to each other;

controlling shift amounts of said pair of work rolls in respective roll axial directions in addition to inclinations of said pair of work rolls, thereby controlling the strip crown of a strip to be rolled, simultaneously spraying a lubricant to between said pair of work rolls and said pair of back-up rolls on the exit side of the mill to lubricate between said work rolls and said back-up rolls thereby to reduce thrust forces exerted on the back-up rolls due to rotation thereof while the axes of said work rolls are crossed with respect to each other, and using, as said lubricant, raw lubricant oil meeting the following requirements or an emulsion of said raw lubricant oil:

(a) the coefficient of friction between said work rolls and said back-up rolls is in the range of 0.4 to 0.1;

(b) the viscosity is not larger than 80 centi-Stokes at 40° C.;

(c) mineral oil and synthetic ester not less than 5% are included as base oil;

(d) a fatty acid in the range of 0.03 to 0.5% is included as an oiliness enhancer; and (e) an extreme pressure additive not less than 0.1% is included.

24. A work rolls crossing type mill comprising:

a pair of work rolls;

a pair of back-up rolls for respectively supporting said pair of work rolls;

cooling means for spraying a coolant onto said pair of work rolls from an exit or entrance side of said mill for cooling said pair of work rolls;

said pair of work rolls being inclined in horizontal planes and arranged such that axes of said pair of work rolls are crossed with respect to axes of said pair of back-up rolls, respectively, and those axes of said pair of work rolls are also crossed with respect to each other; and thrust force reducing means for reducing thrust forces exerted on said pair of back-up rolls and pair of work rolls due to rotation thereof while the axes of said work rolls are crossed with respect to each other;

said thrust force reducing means including lubricant supply units arranged to respectively face said pair of back-up rolls on the exit side of the mill for spraying a lubricant onto surfaces of said back-up rolls at locations spaced from contact positions between said pair of work rolls and said pair of back-up rolls without being impeded by coolant gathering in the contact positions, thereby maintaining a coefficient of friction between said work rolls and said back-up rolls in the range of 0.04 to 0.1.

25. A work rolls crossing type mill comprising:

a pair of work rolls;

a pair of back-up rolls for respectively supporting said pair of work rolls;

cooling means for spraying a coolant onto said pair of work rolls from an exit or entrance side of said mill for cooling said pair of work rolls;

said pair of work rolls being inclined in horizontal planes and arranged such that axes of said pair of work rolls are crossed with respect to axes of said pair of back-up rolls, respectively, and those axes of said pair of work rolls are also crossed with respect to each other; and thrust force reducing means for reducing thrust forces exerted on said pair of back-up rolls and pair of work rolls due to rotation thereof while the axes are crossed with respect to each other;

said thrust force reducing means including lubricant supply units arranged to respectively face said pair of back-up rolls on an exit side of the mill for spraying a lubricant consisting of emulsion prepared by diluting with water a raw lubricant oil containing mineral oil and synthetic ester not less than 5% as base oil onto surfaces of said back-up rolls at locations spaced from contact positions between said pair of work rolls and said pair of back-up rolls without being impeded by coolant gathering in the contact positions, thereby maintaining a coefficient of friction between said work rolls and said back-up rolls in the range of 0.04 to 0.1.

26. A work rolls crossing type mill according to claim 25, wherein said raw lubricant oil further contains a fatty acid in the range of 0.03 to 0.5% as an oiliness enhancer for suppressing vibrations of said pair of back-up rolls and pair of work rolls due to rotation thereof while the axes are crossed to each other.

27. A work rolls crossing type mill according to claim 25, wherein said raw lubricant oil further contains an extreme pressure additive not less than 0.1% for assisting a vibration suppressing function of the fatty acid.

28. A work rolls crossing type mill comprising:

a pair of work rolls;

a pair of back-up rolls for respectively supporting said pair of work rolls;

cooling means for spraying a coolant onto said pair of work rolls from an exit or entrance side of said mill for cooling said pair of work rolls;

said pair of work rolls being inclined in horizontal planes and arranged such that axes of said pair of work rolls are crossed with respect to axes of said pair of back-up rolls, respectively, and those axes of said pair of work rolls are also crossed with respect to each other; and thrust force reducing means for reducing thrust forces exerted on said pair of back-up rolls and pair of work rolls due to rotation thereof while the axes of said work rolls are crossed with respect to each other;

said thrust force reducing means including lubricant supply units arranged to respectively face said pair of back-up rolls on an exit side of the mill for spraying a lubricant prepared by diluting with water a raw lubricant oil containing a fatty acid in the range of 0.03 to 0.5% as an oiliness enhancer for suppressing vibrations of said pair of back-up rolls and pair of work rolls due to rotation thereof while the axes of said work rolls are crossed with respect to each other onto surfaces of said back-up rolls at locations spaced from contact surfaces of said back-up rolls at locations spaced from contact positions between said pair of work rolls and said pair of back-up rolls without being impeded by coolant gathering in the contact positions, thereby maintaining a coefficient of friction between said work rolls and said back-up rolls in the range of 0.04 to 0.1.

* * * * *